US006113290A

United States Patent [19]

Tanaka et al.

[11] Patent Number: 6,113,290

[45] **Date of Patent: *Sep. 5, 2000**

[54] INK JET RECORDING APPARATUS HAVING IMPROVED EDGE DETECTING AND EDGE FORMATION

[75] Inventors: Hideki Tanaka, Yokohama; Shinji Takagi, Kawasaki; Hiroyuki Hyotani, Tokyo; Takehiko Kasamatsu, Fujisawa, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/802,688

[22] Filed: Feb. 19, 1997

[30] Foreign Application Priority Data

Feb. 21, 1996 [JP] Japan ..... 8-033950
Dec. 4, 1996 [JP] Japan ..... 8-324062

[51] Int. Cl.[7] ..... B41J 5/30

[52] U.S. Cl. ..... 400/61; 400/70; 400/76; 347/9

[58] Field of Search ..... 347/9, 14, 15, 347/43, 44, 45, 95, 96, 98, 212; 400/61, 70, 76

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,538,160 | 8/1985 | Uchiyama | 346/140 R |
| 4,558,333 | 12/1985 | Sugitani et al. | 346/140 R |
| 4,608,577 | 8/1986 | Hori | 346/140 R |
| 4,630,076 | 12/1986 | Yoshimura | 347/98 |
| 4,704,615 | 11/1987 | Tanaka | 347/212 |
| 4,723,129 | 2/1988 | Endo et al. | 346/1.1 |
| 4,740,796 | 4/1988 | Endo et al. | 346/1.1 |
| 5,086,484 | 2/1992 | Katayama et al. | 382/50 |
| 5,512,930 | 4/1996 | Brandt et al. | 400/120.18 |
| 5,563,985 | 10/1996 | Klassen et al. | 347/9 |
| 5,596,355 | 1/1997 | Koyama | 343/43 |
| 5,635,969 | 6/1997 | Allen | 347/96 |
| 5,661,507 | 8/1997 | Sperry | 347/9 |
| 5,677,714 | 10/1997 | Klassen et al. | 347/9 |
| 5,898,443 | 4/1999 | Yoshino et al. | 347/19 |

FOREIGN PATENT DOCUMENTS

| | | | |
|---|---|---|---|
| 0 657 849 | 6/1995 | European Pat. Off. | 347/9 |
| 0 684 147 | 11/1995 | European Pat. Off. | 347/9 |
| 54-56847 | 8/1979 | Japan | 347/9 |
| 58-128862 | 8/1983 | Japan | 347/9 |
| 59-123670 | 7/1984 | Japan | 347/9 |
| 59-138461 | 8/1984 | Japan | 347/9 |
| 60-71260 | 4/1985 | Japan | 347/9 |
| 1-63185 | 3/1986 | Japan | 347/9 |
| 3-227644 | 10/1991 | Japan | 347/9 |
| 05202328 | 8/1993 | Japan | 347/9 |
| 8-52867 | 2/1996 | Japan | 347/9 |

*Primary Examiner*—John S. Hilten
*Assistant Examiner*—Charles H. Nolan, Jr.
*Attorney, Agent, or Firm*—Fitzpatrick, Cella, Harper & Scinto

[57] ABSTRACT

An ink jet recording apparatus includes an edge detection unit that detects the positions of pixels in one pixel line in which data changes from 0 to 1 in accordance with the data serially converted from ORed data in a state where the data representing OR of each recording data on each ink color, and a discharge control data formation unit that forms fixing process driving data including data 1 at a given ratio to AND data obtainable by operating AND between the serially converted data from the ORed data and the detection output from the edge detection unit.

25 Claims, 12 Drawing Sheets

INK JET RECORDING APPARATUS HAVING IMPROVED EDGE DETECTING AND EDGE FORMATION

BACKGROUND OF THE INVENTION

1. Field of the Invention

The present invention relates to an ink jet recording apparatus that discharges ink from the ink discharge unit of the recording head unit, which is arranged to face the recording surface of a recording medium, in accordance with recording data for recording by the adhesion of ink thereto, and discharges fixing liquid to fix ink simultaneously.

Also, the present invention relates to an ink jet recording apparatus, and more particularly, it relates to an ink jet recording apparatus that discharges to a recording medium a liquid containing the substance that insolubilizes or coagulates the pigment (which may be referred to as a colorant) in ink before or after the formation of dots recorded (or printed) on the recording medium by the adhesion of ink discharged from each recording head.

2. Related Background Art

For an ink jet recording apparatus, there has been proposed a method for preventing the quality of images from being lowered due to running of ink when images are recorded on the recording surface of a textile or paper recording medium in accordance with recording data. In the specification of Japanese Patent Application Laid-Open No. 58-128862, for example, it is disclosed that a fixing liquid is caused to adhere to the same positions as those in which pixels are formed in order to fix ink on the recording surface before such pixels are formed by the adhesion of ink droplets from the ink discharge unit of the recording head unit to such recording surface or after the pixels are formed by the adhesion of ink droplets from the ink discharge units to the recording surface.

Also, as disclosed in the specification of Japanese Patent Application Laid-Open No. 64-63185, for example, pixels are formed by the adhesion of ink droplets from the ink discharge unit of recording head unit to the recording surface after a chemical compound that insolubilizes dyestuff contained in ink is caused to adhere to the recording surface of a recording medium or as disclosed in the specification of Japanese Patent Application Laid-Open No. 5-202328, for example, a fixing liquid that fixes ink is caused to adhere to the recording surface by the application of ink jet method or by means of roller coating in order to make the surface waterproof before pixels are formed by the ink droplets on the recording surface. It has also been proposed that before ink and its fixing liquid reach a recording surface, that is, at the time when the ink droplets and fixing liquid fly from the respective recording heads, the ink droplets and fixing liquid are mixed, and such mixture is caused to adhere to the recording surface so that waterproof images are formed on it.

As described above, since the fixing liquid adheres to the entire recording surface of a recording medium, there is a possibility that the fixing liquid is wastefully consumed, because it adheres to the portions other than those pixels that require the application of the fixing liquid. Also, when images are formed by use of ink of plural colors, there are some cases where a color mixture takes place due to the fixing liquid that has been applied more than necessary.

Also, in accordance with the conventional examples described above, processing liquid is applied to all the positions of recording dots formed on a recording medium.

Therefore, processing liquid is consumed more than necessary, and particularly when a color recording is executed by use of ink of many colors, a problem is encountered that color mixture occurs due to processing liquid used in an amount more than needed. In order to solve a problem of the kind, there has been proposed in Japanese Patent Application Laid-Open No. 8-52867 (hereinafter referred to as a related technical example) a technique that makes it possible to maximize the function of such processing liquid for the enhancement of the fixing and waterproofing capabilities of ink by its adhesion only to the optimal locations in an optimal quantity.

Here, in conjunction with the accompanying drawings, the description will be made of an example in which an image formation method adopted for the related technical example described above is applied to a color ink jet printer. FIG. 8 is a perspective view which schematically shows such color ink jet printer.

In FIG. 8, a reference numeral 111 designates a head unit provided with recording head 101, 102, 103 and 104, and a head 105 for use of processing liquid. These heads 101 to 105 are provided with 64 discharge ports each, for example, on the respective surfaces facing a recording sheet 307 serving as a recording medium in the conveying direction of the recording sheet 307. Also, for these head 101 to 105, ink paths or processing liquid paths are arranged to be conductively connected with the respective 64 discharge ports. Then, for the corresponding liquid paths, electrothermal transducing elements are formed on the substrates that constitute the heads, respectively, to generate thermal energy for discharging ink or processing liquid. The electrothermal transducing elements generate heat by means of electric pulses to be applied in accordance with recording data whereby to create film boiling in ink or processing liquid and discharge ink or processing liquid from the discharge ports with the development of air bubbles caused by the film boiling thus created. A common liquid chamber is arranged to be conductively connected with each of the liquid paths of the heads 101 to 105, respectively, and ink or processing liquid retained in each common liquid chamber is supplied to the respective liquid paths in accordance with each discharge operation in each of the liquid paths.

The head unit 111 is mounted on a carriage 302. The carriage 302 is slidably coupled with a pair of guide rails 303 extended in parallel with the recording surface 307A of a recording sheet 307. In this way, the head unit 111 travels along the guide rails 303. Along this traveling, the head unit performs recording by discharging ink or processing liquid by the timing that will be described later. After the traveling of the head 111, the recording sheet 307 is conveyed for a given amount in a direction indicated by an arrow. Then, the recording operation is resumed. With the repetition of such operation, recording is executed one after another on the recording sheet 307.

The recording sheet 307 is conveyed by the rotation of a pair of conveying rollers 304 and 305, each arranged above and below the recording surface 307A, respectively. Also, on the reverse side of the recording surface 307A of the recording sheet 307, a platen 306 is arranged to keep the flatness of the recording surface 307A.

In this respect, the traveling of the carriage 302 is possible by means of a belt (not shown) attached to the carriage when the belt is driven by a motor. Also, the conveying rollers 304 and 305 are made rotative likewise when the motor is driven and its rotation is transmitted to them.

FIG. 9 is a block diagram which shows the control system of the printer represented in FIG. 8. In FIG. 9, a CPU 100 executes control and data processes for the operation of each unit of the apparatus including the dot formation of processing liquid which will be described later. On a ROM 100A, procedures and others are stored for the execution of such processes. Also, a RAM 100B is used as a work area for the execution thereof.

In accordance with recording data, ink and processing liquid are discharged from the head unit 111 when the CPU 100 supplies to the head driver 301A the driving data and driving control signals (discharge timing) with respect to the electrothermal transducing elements. Further, the CPU 100 controls the carriage motor 200 to move the carriage 302 and a sheet feeding motor (PF) motor 500 to rotate the conveying rollers 304 and 305 through the motor drivers 200A and 500A.

FIG. 10 illustrates the head unit 111. A reference numeral 101 designates a recording head to discharge cyan (C) ink. Likewise, a reference numeral 102 designates a recording head to discharge magenta (M) ink; 103, a recording head for yellow (Y), and 104, a recording head for black (K). Also, a reference numeral 105 designates a head for use of processing liquid, which discharges the processing liquid that insolubilizes the dyestuff serving as a colorant in ink. The composition of ink and processing liquid will be described later. In this respect, for a printer used for a monochromatic color, the head 105 for use of processing liquid should be provided only for a recording head to discharge black ink, for example.

FIGS. 11A and 11B are views which illustrate the facing relationship between the head unit 111 and recording sheet 307. The head 111 performs its main scan in the direction indicated by an arrow A, while discharging ink of each color, and processing liquid from the head 105. Then, the recording sheet 307 is fed in the direction indicated by an arrow B (in the sub-scanning direction). In this way, images are recorded on the recording surface 307A of the recording sheet 307. In this example, the head 105 for use of processing liquid is positioned on the front side in the main scanning direction. It is arranged that ink of each color is discharged from the recording heads 101, 102, 103, and 104, respectively, after processing liquid has been discharged from the head 105. In other words, after dots of processing liquid are formed by the adhesion of the processing liquid to the recording surface 307A, ink of each color is discharged for the formation of recording dots to record images. In this respect, it may be possible to arrange a structure on the contrary so that after the formation of recording dots, the processing liquid is discharged to form dots of processing liquid.

Now, the description will be made of the discharge operation of ink and processing liquid.

Here, it is assumed that recording data are made as shown in FIG. 12. The data take OR with the corresponding recording data on each ink of C, M, Y, and K, and the entire discharge positions of ink that correspond to the data, that is, the positions of recording dots formed by each ink, are indicated by a mark ○, respectively. This is designated as D1. The numerals 1 to 10 in FIG. 12 indicate the positions where dots are formed in the main scanning direction. Also, the reference marks a to h indicate the recording positions in the sheet feeding direction.

FIG. 13 is a view which illustrates a method for setting control regions at 311 to 330 in FIG. 13 with respect to the recording data shown in FIG. 12. In this case, each control region is a small area equivalent to 2 dots×2 dots. If data on the recording dot formation is present at a given position in each small area, a recording dot D1 is formed after a dot of processing liquid (designated by a mark D2) has been formed in such position on the recording surface 307A. In other words, a mask pattern of two dots by two dots is activated with respect to the recording data, thus producing the data for use of processing liquid. As to the region 311, for example, the data on recording dot formation is present at the coordinates (2, b) (lower right-hand in the region) in FIG. 13, and then, in the corresponding position in the control region 316 in FIG. 13, a ○ is present. Then, processing liquid is discharged to the position at the coordinates (2, b) in the region 311 to form a dot D2 of processing liquid. In other words, according to this example, a structure is arranged so that processing liquid is discharged in an amount of approximately 25% of the OR with the recording data corresponding to each of C, M, Y, and K color ink for recording an image, and after that, the recording dots are discharged. By experiments, it has been confirmed that it should be good enough for processing liquid to be discharged approximately in this amount if the compositions of the processing liquid and ink are such as to be described later. In this case, the head 105 for use of processing liquid discharge is of the same structure as the other heads 101 to 104 for use of recording. The discharge amount of each nozzle is also the same.

In this respect, it may be possible to set the control regions arbitrarily corresponding to the discharge amount of the head that may be used for discharging processing liquid within a range where one dot D2 of processing liquid can produce its effect, not necessarily limited to the setting of a control region in an area equivalent to two dots by two dots.

Nevertheless, according to the related technical example described above, the positions where processing liquid dots are formed on a recording medium are set always the same. Therefore, for example, with the head 105 for use of processing dot formation, which is structured the same as those heads 101 to 105 for use of recording dot formation, the same nozzles of the head 105 are used for discharging processing liquid to form the dots thereof. As a result, the use of nozzles are biased. Also, if a differently structured head should be adopted in place of the head 105 for use of liquid dot formation, while and heads 101 to 104 are still used for forming recording dots, there is a need for the provision of a new head with an inevitable increase of costs. Even with such costly arrangement, only fixed formation of processing liquid dots is executable, making it difficult to flexibly deal with any special modes of processing liquid discharges.

Also, when a control is made to suppress the discharge amount of processing liquid to approximately 25% of each printing location of every C, M, Y, and K, it is inevitable that some one dot of four dots in a certain discharge location presents a complete dot on dot state if the discharge control of processing liquid is made in the same way as the discharge control of color ink. Then, color ink is fundamentally discharged to the three positions where no processing liquid has been discharged for the intended treatment. From the purpose for which processing liquid is discharged, it is desirable to apply the processing liquid to as many color ink discharge positions as possible. Here, however, processing liquid should be discharged to all the discharge positions of C, M, Y, and K if discharge signals are generated in the same process as for discharging color ink without any particular control. In other words, there is no alternative fundamentally but to discharge color ink to the positions where no processing liquid has been discharged unless processing liquid is discharged to cover recording locations 100%.

SUMMARY OF THE INVENTION

In consideration of the problems described above, the present invention is designed. It is an object of the invention to provide an ink jet recording apparatus that discharges ink from the ink discharge unit of the recording head unit arranged to face the recording surface of a recording medium in accordance with recording data for recording by the adhesion of ink thereto, and to discharge fixing liquid to fix ink simultaneously, this apparatus being capable of optimizing the fixing process on the recording surface in accordance with recording data, while preventing the occurrence of any color mixture due to the application of the fixing liquid.

In order to achieve the object described above, the ink jet recording apparatus of the present invention comprises a recording control data supplying unit that supplies recording control data in accordance with recording data on images to be recorded on the recording surface of a recording medium corresponding to the arrangement of the discharge unit of the head, which faces the recording surface and discharges liquid containing the substance that insolubilizes or coagulates colorant in ink that adheres to the recording surface; and a data conversion processing unit that forms discharge control data on liquid discharge operations per arrangement of discharge unit in accordance with the recording control data at a given ratio with respect to the data amount of the recording operation starting at the edge of the data on the recording operation defined by the recording control data corresponding to the arrangement of the discharge unit, and then, supplies the discharge control data to the head control unit that controls the discharge operation of the head. In this respect, the head having the discharge unit that discharges liquid containing the substance that insolubilizes or coagulates colorant in ink may be arranged either integrally in parallel with heads each having a discharge unit that discharges ink or independently of other heads.

Also, in accordance with the present invention, there is provided an ink jet recording apparatus that comprises:

a recording control data supplying unit that supplies recording control data, in accordance with recording data on images to be recorded on the recording surface of a recording medium, corresponding to the arrangement of the discharge unit of the head, which faces the recording surface and discharges liquid containing the substance that insolubilizes or coagulates colorant in ink that adheres to the recording surface;

an edge detecting unit that detects the edge of data on the recording operation defined by the recording control data corresponding to the arrangement of the discharge unit in accordance with the recording control data to be supplied from the recording data supplying unit; and a discharge control data formation unit that forms discharge control data on liquid discharge operation per arrangement of discharge unit in accordance with the recording control data from the recording control data supplying unit, as well as with a given ratio with respect to the data amount of the recording operation on the basis of the detection output data from the edge detection unit, and then, supplies the discharge control data to the head control unit that controls the discharge operation of the head.

It is another object of the invention to provide an ink jet recording apparatus capable of averaging the use ratio of each nozzle of the head for use of processing liquid dot formation even when this head is structured the same as a head for use of recording dot formation.

In order to achieve the object described above, the ink jet recording apparatus of the present invention is provided with an ink discharge unit for the formation of ink dots by discharging ink onto a recording medium, and a liquid discharge unit for the formation of liquid dots by discharging onto the recording medium a liquid containing the substance that insolubilizes or coagulates colorant in ink, this apparatus comprising:

edge detection means for detecting each edge of ink dots to be formed on the recording medium; and control means for controlling the position of liquid dot formation by discharging liquid dots from the liquid discharge unit at a given ratio to ink dots on the basis of each edge detected by the edge detection means.

DETAILED DESCRIPTION OF THE PREFERRED EMBODIMENTS

Figure 3:
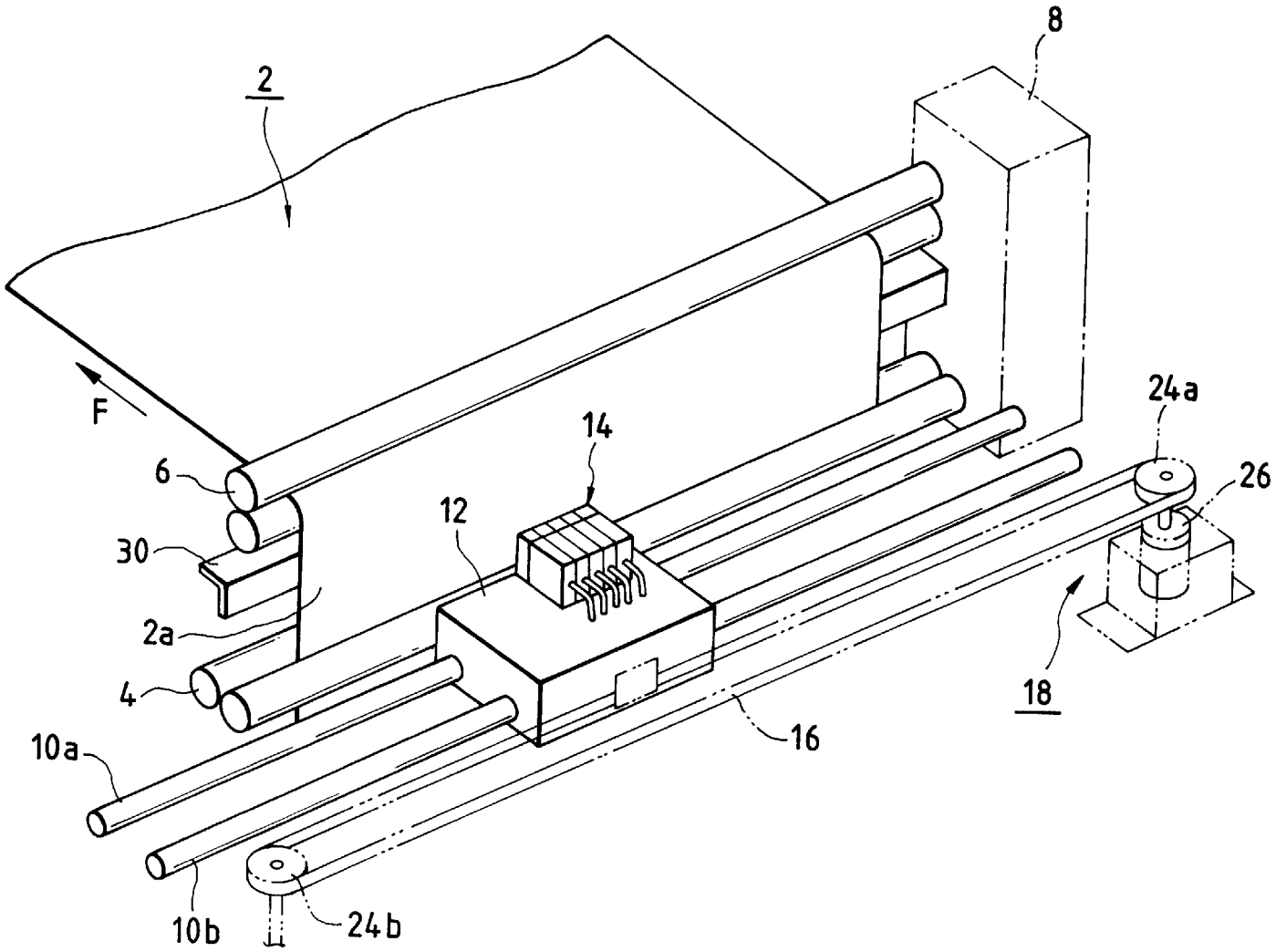
FIG. 3 is a perspective view which schematically shows the principal part of one example of the ink jet recording apparatus of the present invention.

FIG. 3 schematically shows the principal part of one example of the ink jet recording apparatus of the present invention.

The apparatus shown in FIG. 3 comprises sheet feeding roller units 4 and 6 that feed a recording sheet in the direction indicated by an arrow F in FIG. 3 from a recording sheet supplying unit (not shown) that supplies the recording sheet 2 as a recording medium; a conveying roller driving unit 8 that rotatively drives the sheet feeding rollers 4 and 6; a carriage unit 12 that faces the recording surface 2*a* of the recording sheet 2 and travels in the direction almost orthogonal to the conveying direction of the recording sheet 2; and a carriage driving unit 18 that drives a belt member 16 coupled with the carriage unit 12, among some others.

The conveying roller driving unit 8 is controlled in accordance with driving control signals when the signals are supplied from the conveying roller driving circuit 20 which will be described later. With this control, the recording sheet 2 is pinched by the sheet feeding roller units 4 and 6, and intermittently conveyed to the sheet delivery unit (not shown). Also, on the reverse side of the recording surface 2*a* of the recording sheet 2, a platen member 30 is arranged to face it extendedly along the sheet feeding roller units 4 and 6, and support the reverse side in order to keep a given distance between the end face of the recording head and the recording surface 2*a,* which will be described later.

The carriage driving unit 18 is structured with inclusion of a driving motor 25 coupled with a pulley 24*a* through a speed reduction mechanism, as well as with the belt member 16 tensioned around the pulleys 24*a* and 24*b,* which are arranged with a given interval and rotatively supported. The carriage unit 12 is coupled to the middle portion of the belt member 16.

The carriage unit 12 is arranged to face the recording surface 2*a* of the recording sheet 2, and slidably supported by the guide shafts 10*a* and 10*b* that extend substantially in parallel with each other along the sheet feeding roller units 4 and 6. Thus, when driving control signals are supplied to the carriage driving unit 18 from the carriage driving circuit, which will be described later, the driving motor 16 of the carriage driving unit 18 is controlled in accordance with such driving control signals. Then, along the traveling of the belt member 16, the carriage unit 12 moves for a given amount, while being guided by the guide shafts 10*a* and 10*b.*

Figure 4A:
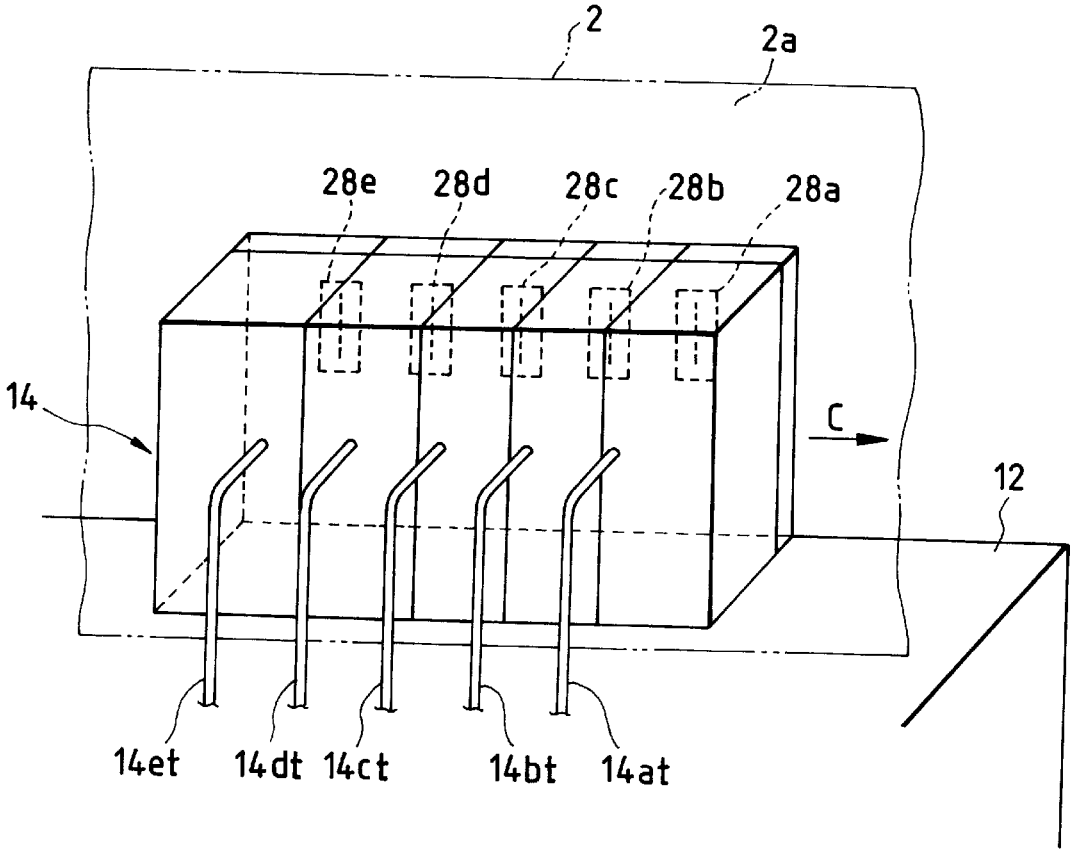
FIG. 4A is a perspective view which is an enlargement of the principal part shown in FIG. 3.

The carriage unit 12 is, as shown in FIG. 4A, provided with ink tanks each retaining ink of different colors, a fixing liquid tank retaining fixing liquid, and a recording head unit 14, respectively. For the recording head unit 14, recording heads 28*a,* 28*b,* 28*c,* 28*d*, and 28*e* are arranged one after another in the scanning direction indicated by an arrow C in FIG. 4A.

Each of the recording heads 28*a*, 28*b*, 28*c*, 28*d,* and 28*e* is of the bubble jet type, for example. Each one of them has many ink discharge units, 64 units, for example, arranged in one line in the conveying direction of the recording sheet 4, and connected to the fixing liquid tank and ink tanks through supplying tubes 14*at,* 14*bt,* 14*ct,* 14*dt,* and 14*et,* respectively.

Here, the recording head 28*a* is connected to the fixing liquid tank. The recording head 28*b*, 28*c*, 28*d,* and 28*e* are connected respectively to the black ink tank, yellow ink tank, magenta ink tank, and cyan ink tank, for example.

In this respect, it may be possible to arrange the recording head 28*a* as a head unit dedicated to use for fixing liquid discharge independent of other heads.

As fixing liquid, the processing liquid that insolubilizes colorant in ink is obtainable as given below, for example. In this respect, "fixing liquid" may be referred to as "processing liquid" or "liquid containing the substance that insolubilizes or coagulates colorant in ink" in the specification hereof.

In other words, after the following compositions are mixed and dissolved, pH is adjusted to 4.8 by use of NaOH, and further, filtered under pressure by use of a membrane filter whose pore size is 0.22 $\mu$m (Product name: Fluoropore filter manufactured by Sumitomo Denki Kogyo K.K.), and then, processing liquid Al can be obtained.

| | |
|---|---|
| Low molecular component of cationic compound<br>Stearyl trimethyl ammonium salt<br>(Product name: Electrostripper QE by Kao K. K.)<br>or Stearyl trimethyl ammonium chloride<br>(Product name: Utamin 86P by Kao K. K.) | 2.0 parts |
| High molecular component of cationic compound<br>Copolymer of diallylamine hydrochloric acid salt<br>and sulfur dioxide<br>(Mean molecular quantity: 5,000)<br>(Product name: Polyamine sulfone PAS-92<br>by Nitto Boseki K. K.) | 3.0 parts |
| Thiodiglycol | 10.0 parts |
| Water | remainders |

Also, as a preferable example of ink that can be mixed with the processing liquid described above for insolubilization, the following can be named:

In other words, yellow, magenta, cyan, and black ink Y1, M1, C1, and K1 are obtainable by mixing the compound given below, which is filtered under pressure by use of a membrane filter whose pore size is 0.22 (Product name: Fluoropore filter By Sumitomo Denki Kogyo K.K.).

Y1

| | |
|---|---|
| C. I. direct yellow 142 | 2 parts |
| Thiodiglycol | 10 parts |
| Acetylenol EH<br>(Manufactured by Kawaken Fine chemical K. K.) | 0.05 part |
| Water | remainders |

M1

With the exception of the dye which is replaced with C. I. acid red 289 ; 2.5, the composition is the same as that of Y1.

C1

With the exception of the dye which is replaced with C. I. acid blue 9 ; 2.5, the composition is the same as that of Y1.

K1

With the exception of the dye which is replaced with C. I. food black 2 ; 3, the composition is the same as that of Y1.

With each mixture of the processing liquid (liquid component) and ink described above, the processing liquid and ink are mixed on the printing material or in a location where the liquid and ink are permeated into the printing material. Consequently, at the first stage of reaction, the component of low molecular quantity or cationic oligomer in the cationic substance contained in the processing liquid and the water soluble dye having the anionic group used for ink are conjugated by the ionic interaction, and then, separation takes place instantaneously from the solution phase.

Then, as the second stage of reaction, the conjugated body of the dye described above, and the low molecular cationic substance or cationic oligomer is absorbed by the high molecular component containing in the processing liquid. Therefore, the size of the coagulated body of the dye created by conjugation becomes larger still, making it difficult for the body to enter the gaps between textures of a printing material. As a result, only the liquid portion where solid-liquid separation has taken place is permeated into the recording sheet after all. In this way, both the quality of prints and fixing capability are achieved. At the same time, the viscosity of the coagulated body, which is formed by the low molecular component of the cationic substance created by the mechanism described above or the cationic oligomer and anionic dye, becomes larger. Hence, there is no possibility that this body moves along the movement of liquid medium. Therefore, even in the formation of a full color image where adjacent ink dots are formed by ink of different colors, there is no possibility that dots are mixed with each other, and that any bleeding takes place. Also, the coagulated body described above is essentially water insoluble, and the waterproof capability of images thus formed are perfect. Further, there is an effect that the light-proof fastness is enhanced for the images thus formed.

In this respect, the term "insolubilize" or "coagulate" used in the specification hereof means the phenomena appearing only in the first stage described above or for the phenomena including both the first and second stages.

Also, in the implementation of the present invention, there is no need for any use of cationic high molecular substance or polyvalent metallic salt having a large molecular quantity as in the prior art, or even when its use is considered necessary, it should be good enough if only such substance or salt is used supplementally in order to enhance the effect of the present invention still more. Therefore, the amount of its use can be minimized. Consequently, as another effect of the invention, it is possible to solve the problem that the coloring capability of dyes is often lowered when it is intended to obtain waterproofing effect by use of cationic high molecular substance or polyvalent metallic salt.

In this respect, when implementing the present invention, there is no particular limit to the printing materials to be used. The copy sheet, bond paper, and others are suitably usable including the so-called ordinary paper sheets conventionally used for printing. The coated paper specially prepared for use of ink jet printing and the transparent film for OHP use can also be used suitably. The high quality paper and lustrous paper that are generally used are also suitably usable.

Figure 4B:
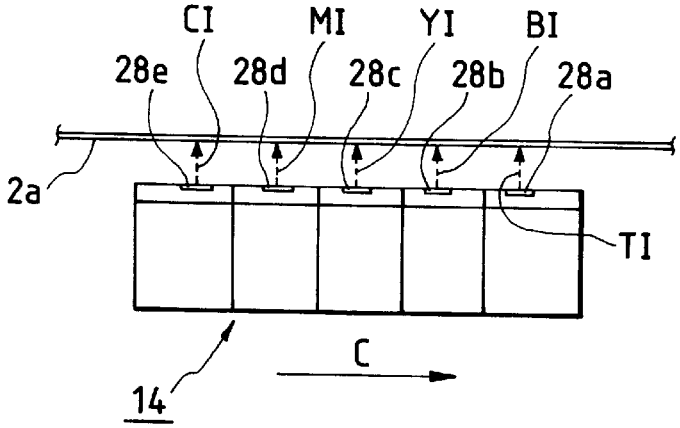
FIG. 4B is a view which illustrates the operation of the principal part of the example shown in FIG. 3.

Now, when the carriage unit 12 travels in the scanning direction indicated by an arrow C in FIG. 4B and reaches a given position of pixel arrangement on the recording surface 2*a*, driving pulse signals are supplied to each of the recording heads. Then, the fixing droplet TI is discharged from the recording head 28*a;* the ink droplet BI of black ink is discharged from the recording head 28*b;* the ink droplet YI of yellow ink, from the recording head 28*c;* the ink droplet MI of magenta ink, from the recording head 28*d;* and the ink droplet CI of cyan ink, from the recording 28*e* to the recording surface 2*a* one after another at a given timing, respectively.

Also, for the ink jet recording apparatus of the present invention, a control block 32 is additionally provided for the recording head unit 14 in order to control recording operations.

Figure 2:
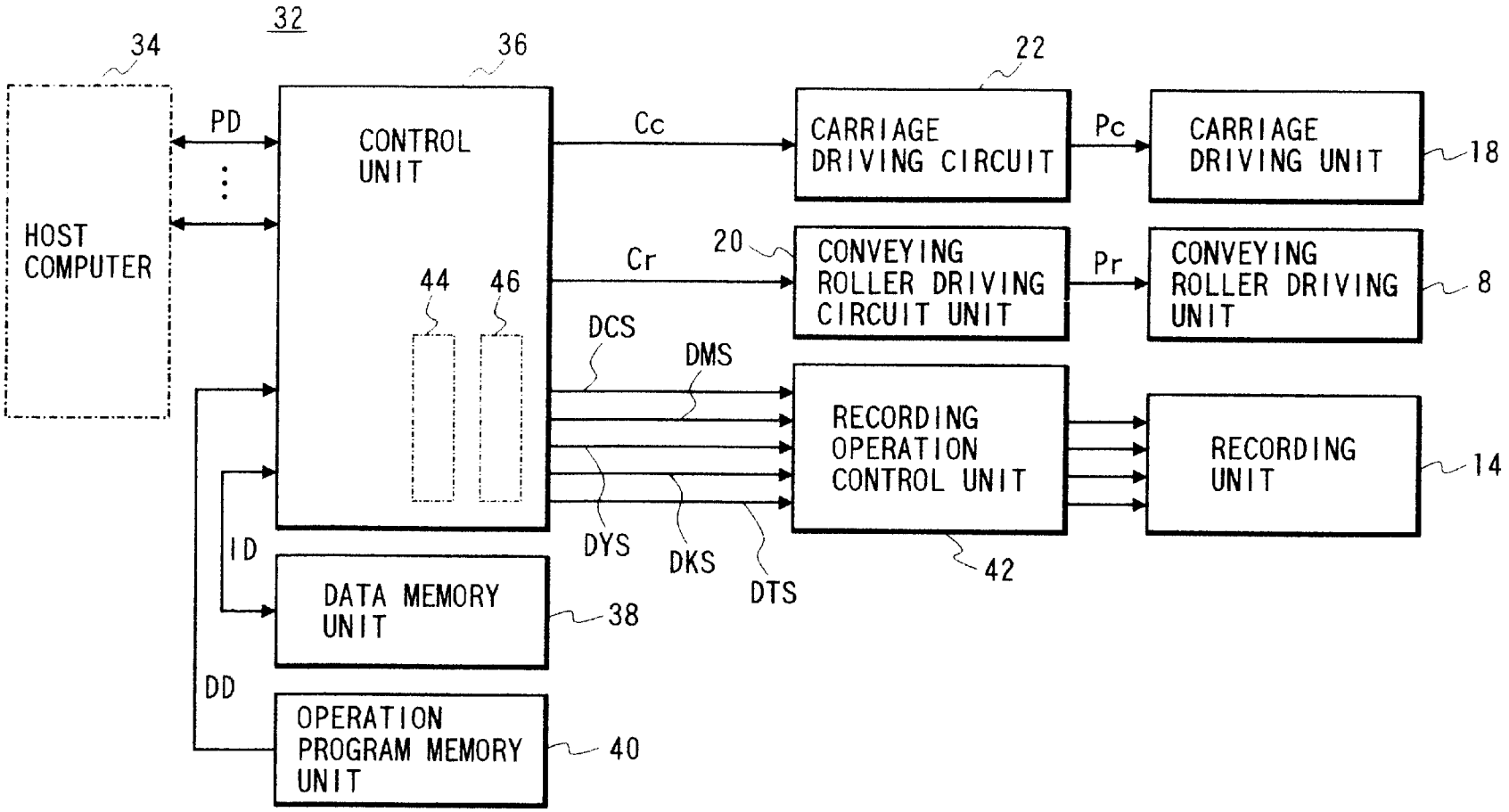
FIG. 2 is a block diagram which shows the structure of a control block in accordance with one example of the ink jet recording apparatus of the present invention.

As shown in FIG. 2, the control block is structured to including the following units as its principal elements:

a carriage driving circuit that forms a given image processing for printing and recording data in accordance with the data groups PD when a host computer 34 supplies the data group PD including printing and recording data, and control data as well, at the same time, forming driving control signals Cr, which are supplied to the conveying roller driving circuit 20, driving signals Cc, which are supplied to the carriage driving circuit 22, and also, driving signals Pc in accordance with the driving control unit 36 that supplies the printing and recording data and recording control data to the recording operation control unit 42, and the driving control signals Cc from the control unit 36 as well, which are supplied to the driving motor in the carriage driving unit 18;

the conveying roller driving circuit 20 that forms driving pulse signals Pr in accordance with the driving control signals Cr form the control unit 36, and supplies them to the driving motor in the conveying roller driving unit 8; and the recording operation control unit 42 that controls the recording operation of the recording head unit 14 in accordance with the recording control data, and with the printing and recording data from the control unit 36.

To the control unit 36, an operation program memory unit 40 is connected to store the operation program that executes image processing procedures, operation control procedures, and others with respect to the carriage driving circuit unit 22 and the conveying roller driving circuit unit 20. The data DD are read out one after another from the operation program memory unit 40 at a given timing, and supplied to the control unit 36, respectively. Also, to the control unit 36, the data memory unit 38 is connected to store the past data IDs needed for processing an interruption or the like, for example. The data read out from the data memory unit 38 are also supplied to the control unit 36 at a given timing one after another.

The control unit 36 is provided with an image processing unit that performs the specific image processes of the printing and recording data in accordance with the data group PD supplied from the host computer 34. The image processing unit comprises, with inclusion of some others, a binarization data selecting and supplying unit 44 that selectively supplies the binarization data obtainable by image processing in accordance with the printing and recording data corresponding to each of the recording heads 28*b*, 28*c*, 28*d,* and 28*e* of the recording head unit 14; and the data conversion processing unit 46 that converts the binarization data to serial data in order to make each of the data per bit in the binarization data, which are read out from the binarization data selecting and supply unit 44, agreeable with each ink discharge unit of each of the recording heads in synchronism with the movement of the carriage unit 12, and also, supplies the discharge control data of fixing liquid TI.

Figure 1:
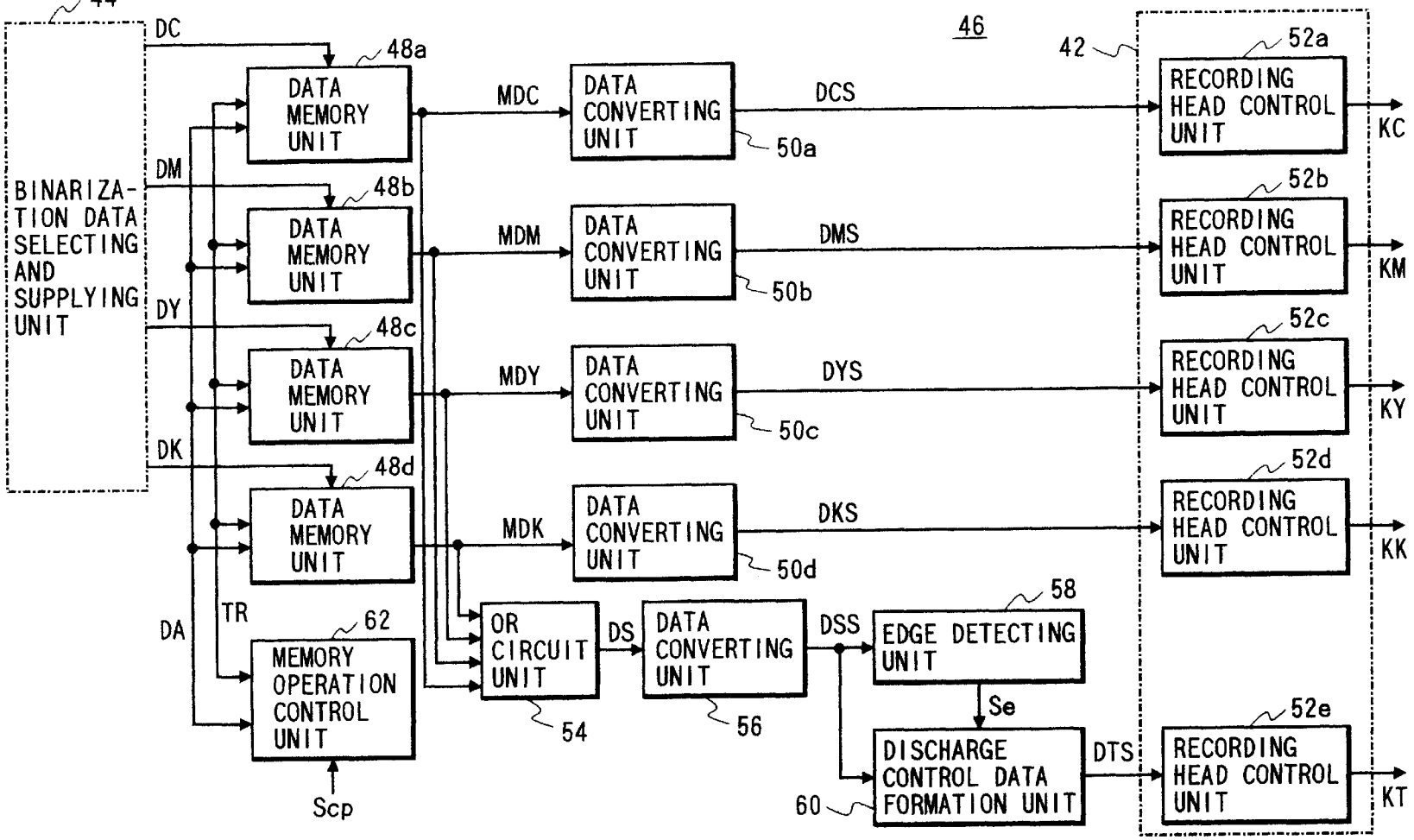
FIG. 1 is a block diagram which shows the structure of a data conversion processing unit in accordance with one example of the ink jet recording apparatus of the present invention.

As shown in FIG. 1, the data conversion processing unit 46 is provided with a data memory unit 48*a* that stores the recording operation data DC supplied from the binarization data selecting and supplying unit 44 for the recording head 28*e;* a data memory unit 48*b* that stores the recording operation data DM supplied from the binarization data selecting and supplying unit 44 for the recording head 28*d;* a data memory unit 48*c* that stores the recording operation data DY supplied from the binarization data selecting and supplying unit 44 for the recording head 28*c;* a data memory unit 48*d* that stores the recording operation data DK supplied from the binarization data selecting and supplying unit 44 for the recording head 28*b*.

Each of the stored operation data DC, DM, DY, and DK is stored per data (one pixel line portion on the recording surface 2*a*) corresponding to 64 ink discharge ports of each recording head of the recording head unit 14 at least immediately before a recording operation, for example. In this respect, the storage is not necessarily limited to this example, but it may be possible to store each of the stored recording operation data DC, DM, DY, and DK per scanning portion of the carriage unit 12. To each of the data memory units 48*a*, 48*b*, 48*c*, and 48*d*, a memory operation control unit 62 is connected, respectively.

To the memory operation control unit 62, the positional signals Scp are supplied by means of encoder to indicate the positions of the recording head unit 14 in the scanning direction with respect to the recording surface 2*a* when the recording head unit 14 begins to move along the recording surface 2, while facing it or when the recording head unit travels. The memory operation control unit 62 forms the read-out timing signal TR in accordance with the positional signals Scp, and then, supplies it to each of the data memory units 48*a*, 48*b*, 48*c*, and 48*d* together with the respective memory address data DA.

At this juncture, the read-out signal TR is formed so that each of the recording heads 28*b*, 28*c*, 28*d*, and 28*e* is able to read out each data from the data memory units 48*a*, 48*b*, 48*c*, and 48*d* one after another when each head arrives at the respective positions of a designated same pixel line on the recording surface 2*a* accordingly. Also, when the recording head 28*a* arrives at the position of a designated same pixel line on the recording surface 2*a*, the read-out timing signal TR is formed so that this head can read out each data from each of the data memory units 48*a*, 48*b*, 48*c*, and 48*d* at a time. This way, 64-bit data MDC, MDM, MDY, and MDK are read out from the data memory units 48*a*, 48*b*, 48*c*, and 48*d*, and transferred, respectively.

To the output side of each of the data memory units 48*a*, 48*b*, 48*c*, and 48*d*, the data converting units 50*a*, 50*b*, 50*c*, and 50*d* are connected, respectively, together with an OR circuit unit 54.

In the data converting units 50*a*, 50*b*, 50*c*, and 50*d*, converting processes are executed to serialize data for each ink discharge unit of the recording heads in accordance with the data MDC, MDM, MDY, and MDK from the data memory units 48*a*, 48*b*, 48*c*, and 48*d*. In this way, the data are prepared in the 64-bit structure to make it possible to obtain data DCS, DMS, DYS, and DKS, which correspond to each ink discharge unit per bit, respectively.

The data DCS, DMS, DYS, and DKS are supplied to each of the recording head control units 52*a*, 52*b*, 52*c*, and 52*d*, which constitute the recording operation control unit 42. Each of the recording head control units 52*a*, 52*b*, 52*c*, and 52*d* is provided with a shift register, for example, to provisionally hold data DCS, DMS, DYS, and DYK at a given timing when data of 64-bit portion are received, and to supply them as driving signals KC, KM, KY, and KK, respectively, for example.

The OR circuit unit 54 executes OR operations per bit in accordance with each of the data MDC, MDM, MDY, and MDK supplied from each of the data memory units 48*a*, 48*b*, 48*c*, and 48*d* to obtain the 64-bit data DS, and supplies it to the data converting unit 56. In this way, the OR operation is executed for each of the data MDC, MDM, MDY, and MDK per one pixel line that corresponds to the arrangement of ink discharge units with respect to the recording surface 2*a*.

The data converting unit 56 executes data conversion process to serialize data corresponding to each ink discharge unit of the recording head 28*a* in accordance with the data DS supplied from the OR circuit unit 54. In this way, the serially converted data DSS is obtained, which is supplied to the edge detecting unit 58, as well as to the discharge control data formation unit 60.

The edge detecting unit 58 detects data changes per bit in accordance with the data DSS. For example, if the data changes from 0 to 1, this unit forms the detection output Se that takes a high level (1), and supplies it to the discharge control data formation unit 60. Therefore, it is assumed that the signal is supplied to the discharge control data formation unit 60, which indicates the shift from the point where no ink discharge is demanded on the recording surface 2*a* for every one pixel line (that is, the point where no data is present for printing) to the point where ink discharge begins (that is, the point where recording data are present for printing, and pixel is formed).

The discharge control data formation unit 60 defines the ratio at which a fixing liquid process should be executed for the recording data on one pixel line with respect to any pixel lines that require the fixing process on the recording surface 2*a*, such as odd numbered lines or even numbered lines, or all the pixel lines. The discharge control data formation unit 60 defines "2" as a discharge frequency (discharge data interval) if a fixing process should be executed for one pixel of two pixels on one pixel line, for example. Then, the discharge control data formation unit 60 operates AND between the per-bit data and the detection output Se in accordance with the data DSS corresponding to each ink discharge unit per bit with the definition that the discharge frequency is "2". In this case, the discharge control data formation unit 60 supplies to the recording head control unit 52*e* the data DTS (1010000 . . . ) as an output data if the detection data Se is supplied at the outset and the result of the AND operation is 1 four times in succession (1111000 . . .) for one pixel line, for example.

The recording head control unit 52*e* is provided with a shift register, for example, to provisionally hold the data DTS in the shift register at a given timing when the data of 64-bit portion is received, and supplies it to the recording head 28*e* as a driving signal KT, for example.

Figure 7:
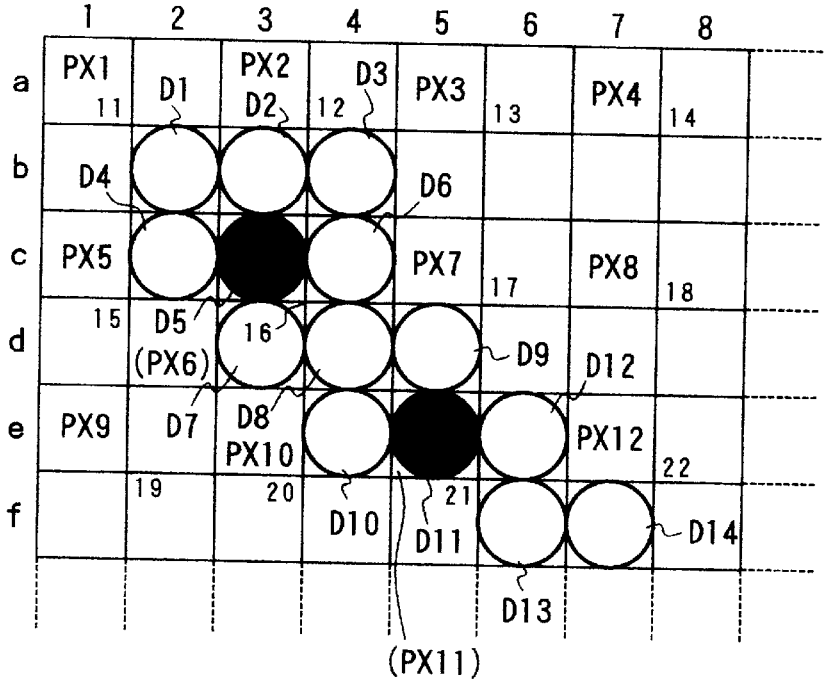
FIG. 7 is a view which illustrates the operation of the prior art.
Figure 8:
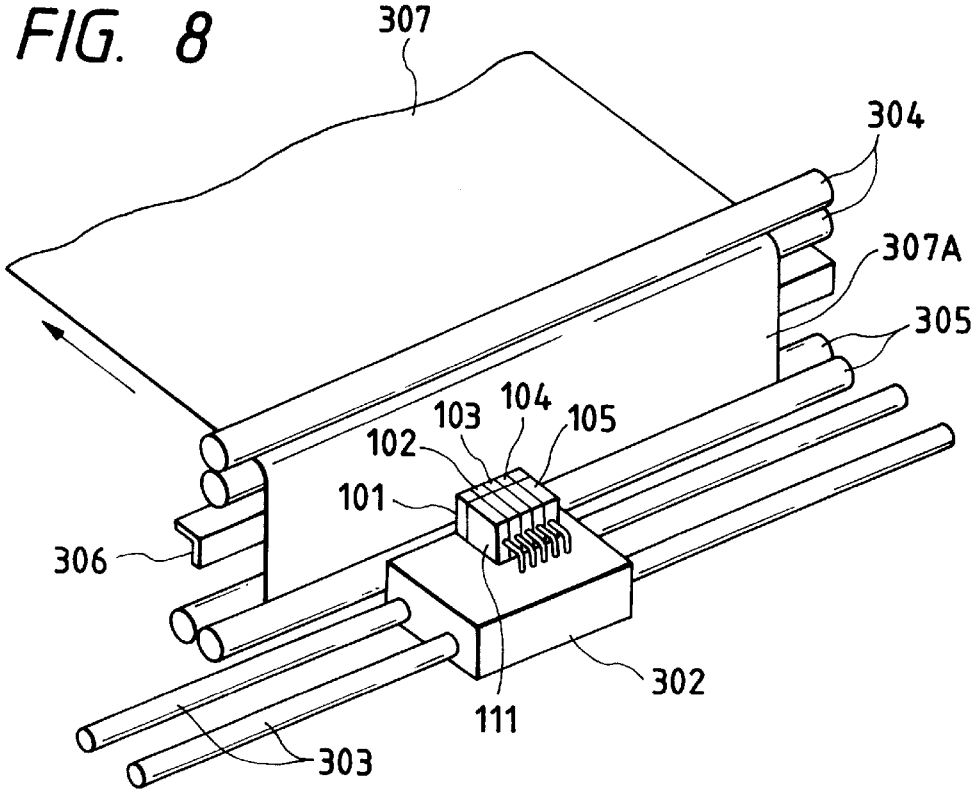
FIG. 8 is a perspective view which shows the principal part in accordance with another example of the ink jet printer of the present invention.
Figure 9:
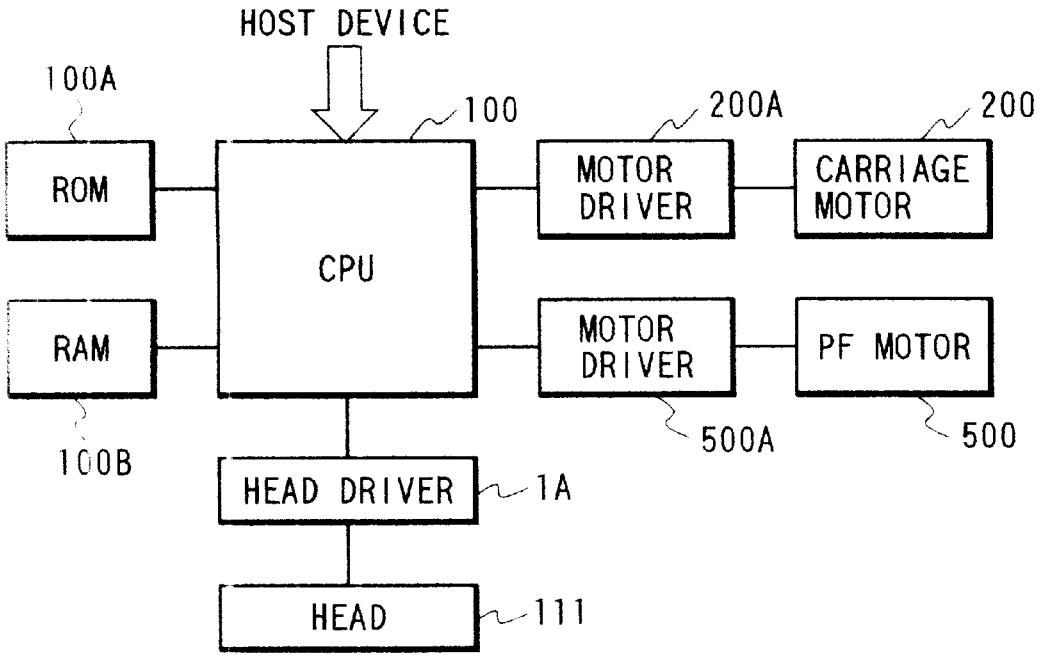
FIG. 9 is a block diagram which shows the control system of the ink jet printer of the present invention.
Figure 10:
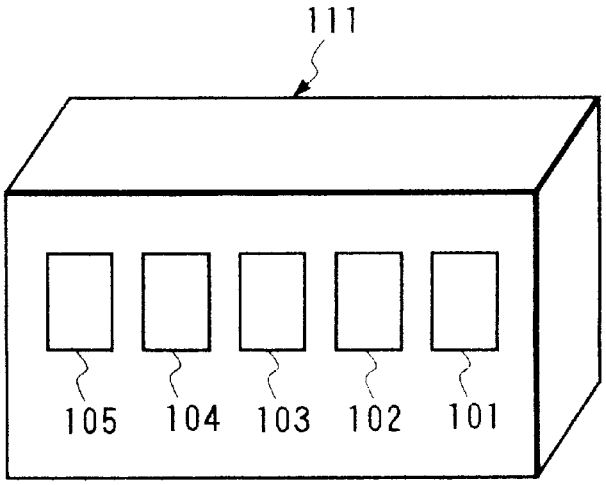
FIG. 10 is a perspective view which schematically shows a head.
Figure 11A:
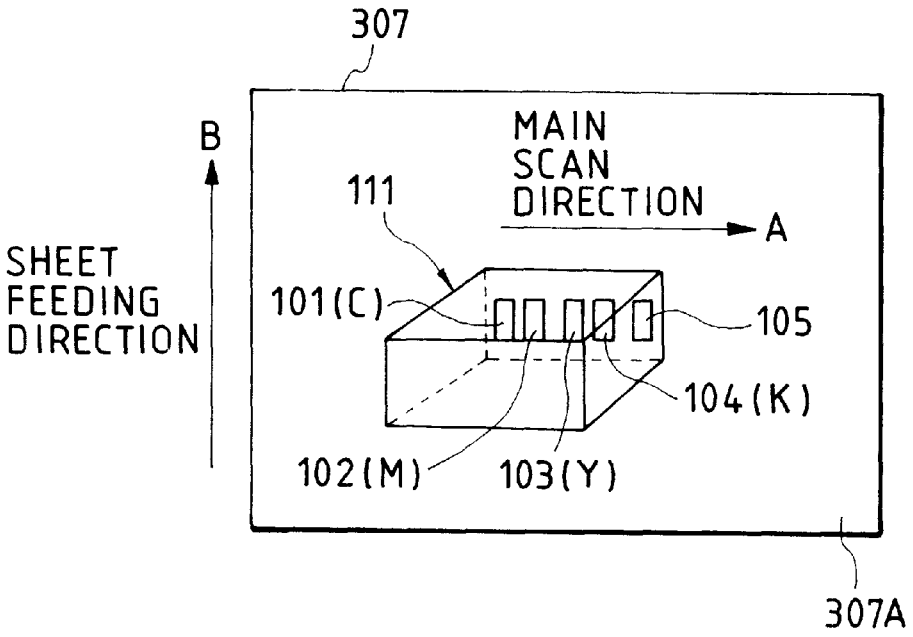
FIGS. 11A and 11B are views which illustrate the positional relationship between a head and a recording sheet.
Figure 11B:
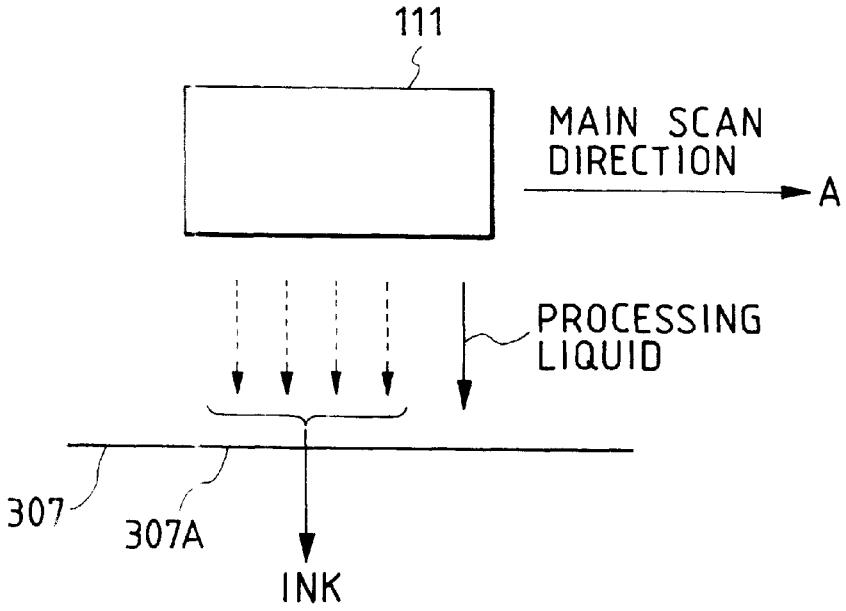

The inventor hereof has proposed in the previous application that an optimal quantity of fixing liquid is provided for its adhesion to the optimal position in a pixel arrangement that forms an image on the recording surface. In other words, on the recording surface of a recording medium, ink droplets having substantially the same discharge amount arrive at the recording surface from the ink discharge unit of the recording head unit in accordance with the recording data, thus arranging and forming a plurality of pixels as arranged as shown in FIG. 7, for example. In FIG. 7, numbers (1, 2, 3, . . . ) that indicate the positions on the pixel lines are provided on the axis of abscissa in the traveling direction of recording heads (main scanning direction), while marks (a, b, c, . . . ) indicating the positions corresponding to each ink discharge unit of the recording heads are provided on the axis of ordinate in the feeding direction of a recording medium (sub-scanning direction). This arrangement represents a part of the pixel collection that constitutes an image on the basis of the recording data. Each mark ○ (D1, D2, . . . , D14) indicates one pixel formed by each ink droplet that arrives at the recording surface in accordance with the recording data, while each mark ● indicates the state where fixing liquid adheres in addition to the ink droplet, respectively.

In order to effectuate the adhesion of fixing liquid to optimal positions in pixels in optimal quantities for the formation of an image with the arrangement described above, the recording surface should be divided into given numbers of small regions (region 11, 12, . . . , 22), within the range of which one droplet of fixing liquid is considered to produce its effect, for example. Then, a given one position in each small region, such as each upper left coordinate position of PX1 (1, a), PX2 (3, a) . . . , PX12 (7, e), is defined as a position where the fixing process is executed. If it is found that the recording data is present at such position, an ink droplet is caused to adhere corresponding to each of the positions where the recording data are present, and at the same time, it is assumed that fixing liquid adheres to substantially the same position where the ink droplet adheres for the formation of pixel, such as two positions (PX6 and PX11) indicated by the mark ● in FIG. 7. In this way, when the recording data are present in such small region, it is assumed that a fixing process is executed so that fixing liquid adheres to an area equivalent to a 25% of such region, that is, [one pixel per given small region (four pixels)].

However, since the positions where fixing liquid adheres are fixed in each of such small regions, the areas where fixing liquid should adhere may be reduced depending on images to be made in accordance with each of the recording data. Also, since the positions where fixing liquid adheres are fixed in each of such small regions, the ink discharge units from which fixing liquid is frequently discharged are fixed accordingly. Therefore, the correlative durabilities of ink discharge units are caused to vary inevitably, making it impossible to obtain the desired life of the recording head unit as a whole. Also, if a recording head is arranged independently to discharge fixing liquid only, the part numbers increase. At the same time, if recording is executed using plural colors of ink, there is a fear that its control of recording operation becomes more complicated. In this respect, therefore, a fixing process is arranged to be executed as described later.

Figure 5:
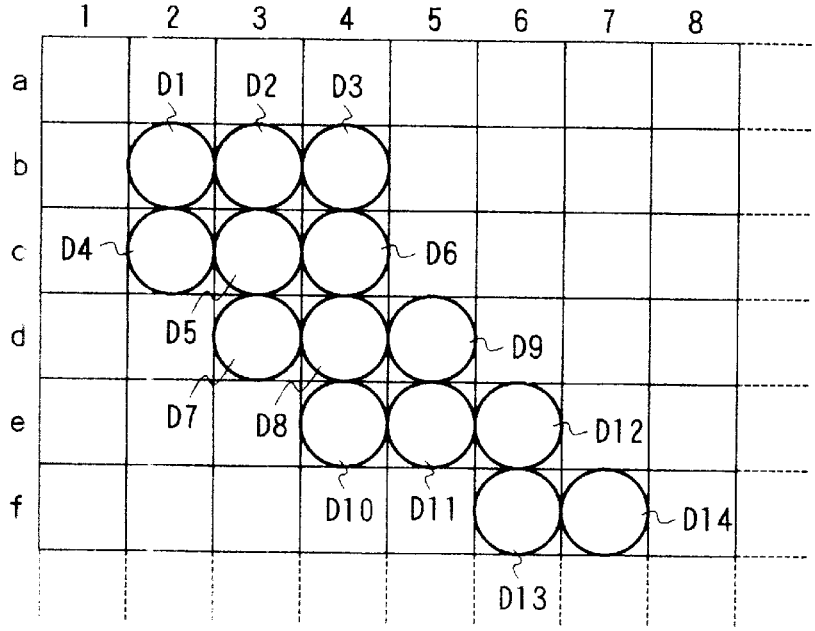
FIG. 5 is a view which illustrates the operation of the example shown in FIG. 1.

As shown in FIG. 5, there is a case where ink droplets each having substantially the same discharge amount arrive at the recording surface of a recording medium from the ink discharge units of recording head unit to form plural pixel arrangements, for example. Here, the description will be made of an example in which a fixing process is executed to cause fixing liquid to adhere to a 25% of pixels thus formed, that is, [one pixel for every four pixels]. In this respect, numbers (1, 2, 3, . . . ), which indicate the positions of pixel lines on the recording surface, are taken on the axis of abscissa in the traveling direction of the recording heads (main scanning direction), while marks (a, b, c, . . . ), which indicate the position corresponding to each ink discharge unit of the recording head unit, are taken on the axis of ordinate in the feeding direction of the recording medium (sub-scanning direction) in FIG. 5 in the same manner as in FIG. 7 in order to represent a part of the pixel collection that constitutes an image in accordance with the recording data. In FIG. 5, each mark ○ (D1, D2, . . . , D14) indicates one pixel formed by each of the ink droplets that has arrived at the recording surface in accordance with the recording data.

When a fixing process is executed for the 25% adhesion of fixing liquid [one pixel for every four pixels], the memory operation control unit 62, at first, reads out data MDC, MDM, MDY, and MDK regarding the 2nd, 4th, 6th, and 8th pixel lines with the arrival of the recording head 28*a* at such even numbered pixel lines, for example, and then, in order to supply only these read-out data to the OR circuit unit 54, this unit supplies the memory address data DA and the read-out timing signal TR to each of the data memory units 48*a*, 48*b*, 48*c*, and 48*d* simultaneously. Also, the memory operation control unit 62 supplies the read-out timing TR to each of the data memory units 48*a*, 48*b*, 48*c*, and 48*d* one after another when the recording heads 28*b*, 28*c*, 28*d*, and 28*e* arrive at each of the same pixel lines, beginning at the first pixel line on the recording surface 2*a* accordingly. In this way, each recording data are read out per 64 bits for each of the pixel lines, and supplied to each of the data converting units 50*a* to 50*d*.

In FIG. 5, when each of the recording data are read out per 64 bits with respect to the pixel lines designated by the numbers 2, 4, 6, and 8, which indicate the positions on the recording surface, the OR circuit unit 54 operates OR per bit in accordance with each recording data, thus obtaining the 64-bit data DS, which is supplied to the data converting unit 56. The data converting unit 56 processes the data DS on the even numbered pixel lines to serialize them per each ink discharge unit of the recording head 28*a*. In this way, the data DSS is obtained and supplied to the edge detecting unit 58 and the discharge control data formation unit 60, respectively.

The edge detecting unit 58 forms the detection output Se that takes a high level (1) if the second pixel line is the data that indicates pixel D1, for example, and supplies it to the discharge control data formation unit 60. Also, this unit forms the detection output Se that takes a high level (1) if the fourth pixel line is the data that indicates pixel D3, and the sixth pixel line is the data that indicates pixel 12, and supplies them to the discharge control data formation unit 60. In this respect, if there is any recording data with respect to the 64th discharge unit of a recording head, it may be possible to detect such data as an edge, and supply a detection output Se.

Now, the discharge control data formation unit 60 defines "2" as the discharge frequency (discharge data interval) in which fixing liquid process is executed for one pixel in two pixels in one pixel line. Then, the discharge control data formation unit 60 operates AND between data and detection output Se per bit in accordance with the data DSS with the discharge frequency being defined as 2 with respect to each ink discharge unit.

In this case, since the result of the AND operation is (01100000 . . . ) that is 1 in two times in succession with respect to the second pixel line in FIG. 5, for example, the data DTS (01000000 . . . ) is supplied to the recording head control unit 52*e* as the output data. Also, with respect to the fourth pixel line, the result of the AND operation is (01111000 . . . ) that is 1 in four times in succession. Therefore, the data DTS (01010000 . . . ) is supplied to the recording head control unit 52*e*. With respect to the sixth pixel line, the result of the AND operation is (00001100000 . . . ) that is 1 in two times in succession. Therefore, the data DTS (00001000000 . . . ) is supplied likewise.

Figure 6:
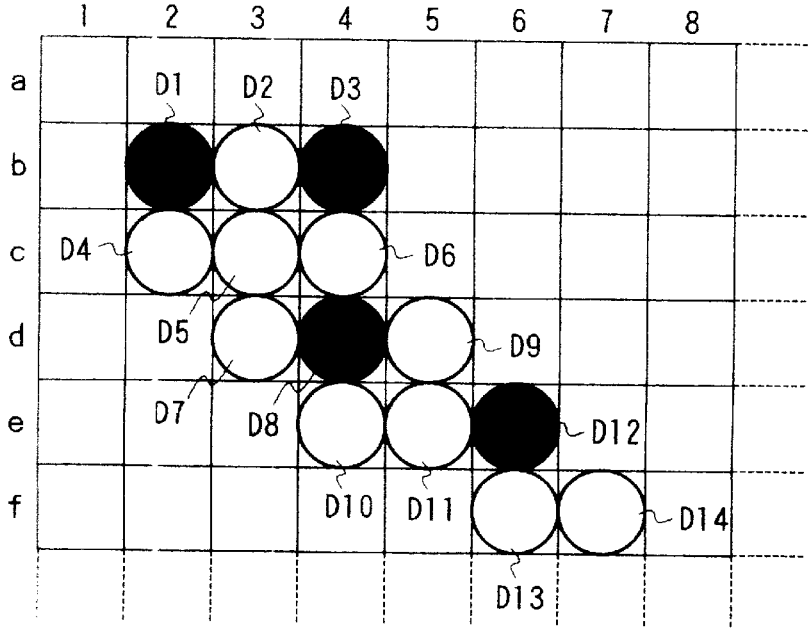
FIG. 6 is a view which illustrates the operation of the example shown in FIG. 1.

In this way, the fixing liquid droplets are discharged from the recording head 28*e* to the designated positions, and fixing liquid adheres in addition to ink droplets as indicated by the mark ● in FIG. 6. In this respect, numbers (1, 2, 3, . . . ) that indicate the positions of pixel lines on the recording surface are taken on the axis of abscissa in the traveling direction of the recording heads (main scanning direction), while marks (a, b, c, . . . ) that indicate the positions corresponding to each ink discharge unit of the recording head are taken on the axis of ordinate in the feeding direction of the recording medium (sub-scanning direction) in FIG. 6 in the same manner as in FIG. 5 in order to represent a part of the pixel collection that constitutes an image in accordance with the recording data. In FIG. 5, each mark ○ (D1, D2, . . . , D14) indicates one pixel formed by each of the ink droplets that has arrived at the recording surface in accordance with the recording data.

Therefore, the fixing process is optimally executed on the recording surface 2*a* in accordance with the recording data. Moreover, there is no possibility that the ink discharge unit from which fixing liquid should be discharge is not fixed, making it possible to average the use ratio of the ink discharge unit for the execution of fixing process.

Here, in accordance with the example described above, the structure is arranged so that the edge detection is executed by the edge detecting unit 58 in accordance with the recording data to be supplied one after another without the provision of any memory unit for storing the recording data that have been serialized when forming the control data on fixing liquid discharges. However, the present invention is not necessarily limited to such structural arrangement. For example, it may be possible to provide a memory unit that stores the serialized data, and read them out from such memory unit one after another to detect edges. In this case, the direction in which edges are detected becomes arbitrary. It is also made possible to discharge fixing liquid to the pixels that become all the edges.

Also, the above example is applicable to the case where one pixel is formed by means of the same ink discharge unit of the recording head. However, the present invention is not necessarily limited to it. For example, it may be possible to arrange the structure so that the above ratio is made changeable in the discharge control data formation unit 60 as in the so-called multiscan method where each pixel in a pixel line in the main scanning direction is formed by plural ink discharge units of one and the same recording head in order to reduce the influences exerted by the variation of ink discharge units of each recording head.

As clear from the above description, the ink jet recording apparatus of the present invention makes it possible to form discharge control data that indicate the liquid discharge operation per arrangement of discharge ports by a given ratio with respect to the amount of recording control data in accordance with the detection output data from the edge detecting unit, and to supply such data to the head control unit that controls the discharge operation of the head unit in order to optimally execute the fixing processes on the recording surface corresponding to the recording data. Furthermore, with this arrangement, there is no possibility that color mixture takes place due to the application of fixing liquid, while the use ratio is averaged for the discharge unit to be used for executing fixing processes.

Hereinafter, the detailed description will be made of another mode embodying the present invention in accordance with the embodiment of a "color ink jet printer".

The present embodiment will be described in accordance with the example of the color ink jet printer referred to in the related technical example. The brief structure of the present embodiment is of the same as the one described in conjunction with FIG. 8 to FIG. 11B. Therefore, the detailed description thereof will be omitted. Here, the data control of processing liquid will be described corresponding to the recording data represented in FIG. 12.

Figure 14:
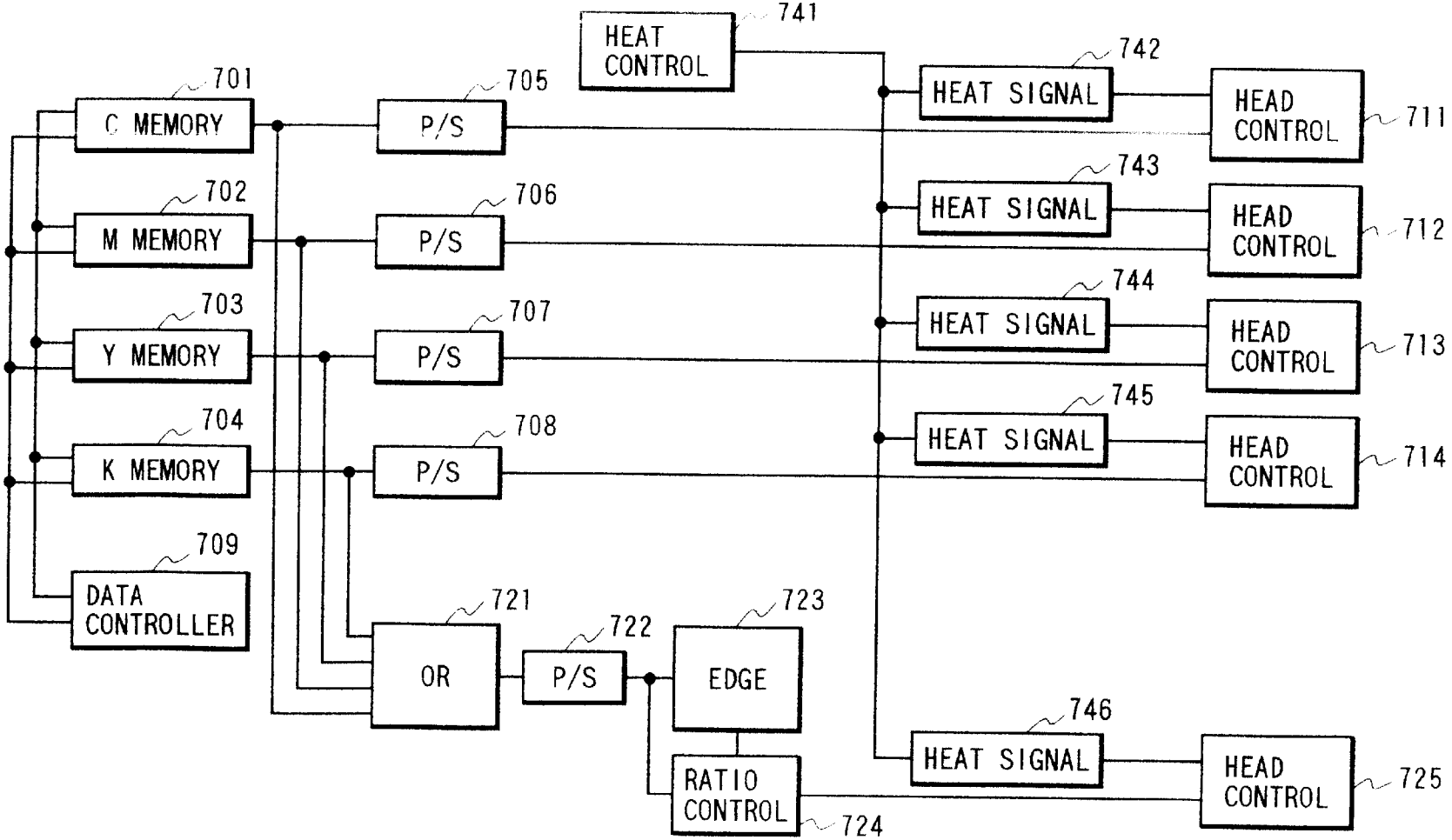
FIG. 14 is a block diagram which shows the principal part of one embodiment in accordance with another mode embodying the present invention.

FIG. 14 is a block diagram which shows the principal structure of the present embodiment. In FIG. 14, reference numerals 701, 702, 703, and 704 designate memories storing recording data (also referred to as discharge data) provided for cyan ink, magenta ink, yellow ink, and black ink, respectively. These memories store at least recording data immediately before recording for each of the recording heads 101, 102, 103, and 104. The data are read out one after another in accordance with the recording timing. Reference numerals 705, 706, 707, and 708 designate parallel-serial converting unit to convert the parallel data read out from the memories 701 to 704 to the serial data corresponding to the respective nozzles of each head. In this case, the data are converted to the serial data for use of 64 nozzles. Reference numerals 711, 712, 713, and 714 designate the head driving circuits that correspond to the cyan head 101, magenta head 102, yellow head 103, and black head 104, respectively. These circuits store on shift registers the data being serially supplied thereto, and latch them in accordance with the discharge timing to make them recording data.

A reference numeral 721 designates the circuit that operates OR for data received from the recording data memories 701, 702, 703, and 704; 722, a parallel-serial converting circuit of the same type as those designated by numerals 705, 706, 707, and 708 to convert the signals from the OR circuit 721 to serial data; 723, an edge detecting circuit that holds the point where the signal data supplied by the parallel-serial converting circuit change from 0 to 1; 724, a ratio control unit that outputs signals corresponding to the ratio between processing liquid dots and recording dots on the basis of edge signals; 725, a head driving circuit for the head 105 for use of processing liquid, which stores on a shift register the data serially supplied from the ratio control unit 724, and latches them in accordance with the discharge timing to make them recording data; and 709, the data controlling unit that outputs signals to each of the recording data memories 701, 702, 703, and 704 to be read out along the movement of the head 111.

Now, it is assumed that with the structure arranged as described above, the head 105 for use of processing liquid arrives at a position on the recording sheet. The data controlling unit 709 outputs addresses and read-out signals to each of the recording data memories 701, 702, 703, and 704 in accordance with signals or the like from an encoder (not shown) along the traveling of the head 111 in order to read out the recording data from each of the memories 701 to 704 for each head corresponding to the position of the head 105 on the recording sheet. Now that the data read out from each of the memories 701 to 704 are 64-bit data on each color, OR is executed per bit for each data in the OR circuit 721. In other words, the OR is operated for data of each color per pixel on the recording sheet in order to output the 64-bit data, and then, converted to the serial data by means of the next parallel-serial converting circuit 722. The serial data thus provided are output to the edge detecting circuit 723 and the ratio control circuit 724 as well.

The edge detecting circuit 723 detects the point where data 0 (no discharge) changes to data 1 (discharge) with respect to the serial data. The detected edge signal is inputted into the ratio control circuit 724 to set its output at 1. In other words, the edge portion (where there is a point at which "no discharge" changes to "discharge") is always set at 1. Then, AND is operated between the signal 1, which is formed in the interior of the ratio control circuit 724 in accordance with the data interval defined in advance corresponding to the ratio between processing liquid dots and recording dots, and the output of the parallel-serial converting circuit 724 at that time. The result thereof is output from the edge detection signals. In other words, when the data position of the data interval corresponding to the ratio between processing liquid dots and recording dots agrees with the position where OR signals exist for recording data subsequent to the edge detection signals having been provided, the output of the ratio control circuit 724 becomes 1. The data thus processed are transferred to the head driving circuit 725 as they are as serial data. The head driving circuit 725 inputs the serial data into a shift register (not shown) and latches them at the stage where the data transfer reaches 64 bits. In accordance with the data thus prepared, processing liquid is discharged as required at the timing of discharge timing signals.

Also, regarding other heads, when the heads for use of recording arrive at certain position of a recording sheet, data corresponding to the positions of such heads on the recording sheet are read out from the memories 701 to 704 and output accordingly. The data are converted to serial data by means of the parallel-serial converting circuits 705 to 708 and transferred to the head driving circuits 711 to 714, thus enabling each ink to be discharged as required at the timing of discharge timing signals.

Each of the discharge timing signal generation units 742 to 745 generates the respective discharge timing signals agreeable with the discharge timing of each color in consideration of the nozzle intervals of each head, and of the ink compositions of each color in accordance with the signals from the discharge timing control unit 741 based upon the signals from an encoder or the like, and outputs such timing signals to each of the head driving circuits 711 to 714, hence performing discharges from the nozzles whose outputs are 1 at such timing.

Figure 12:
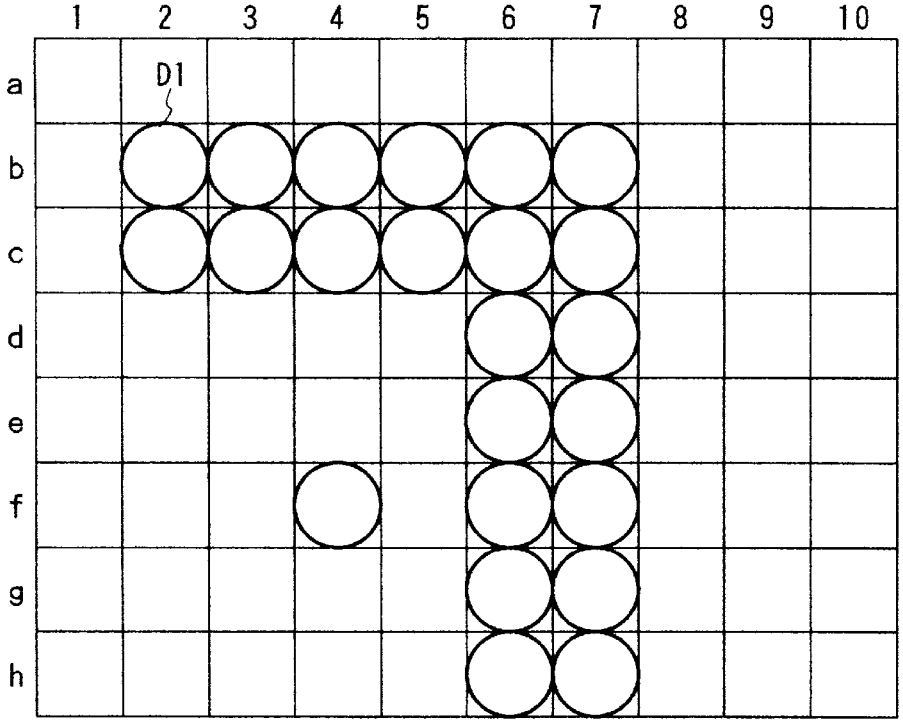
FIG. 12 is a view which shows the example of recording dots formed by means of the related technical example.
Figure 13:
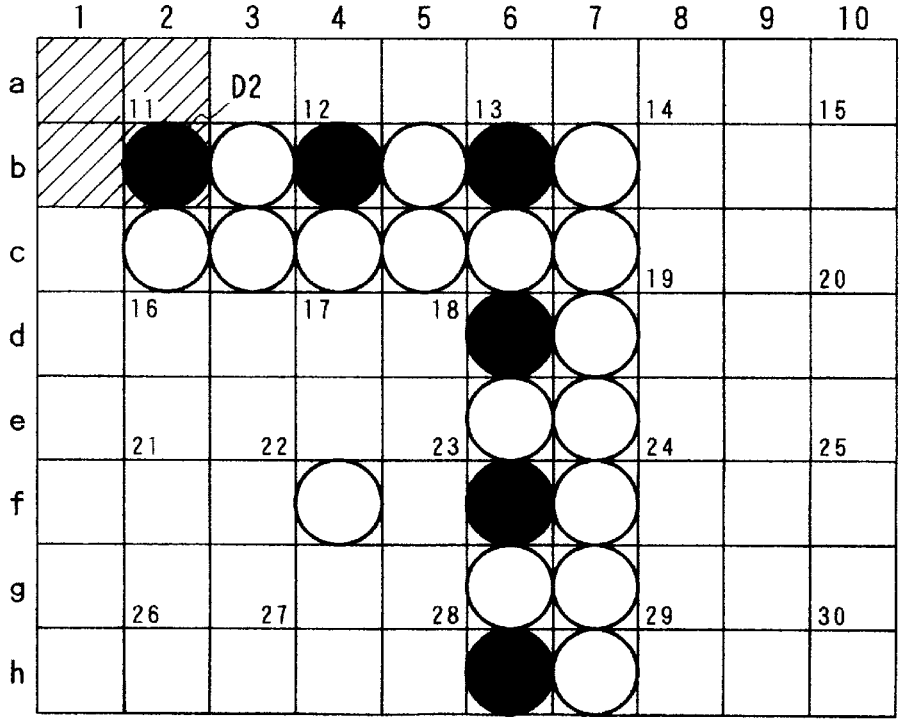
FIG. 13 is a view which shows the example of recording dots and processing liquid dots formed by the related technical example.
Figure 15:
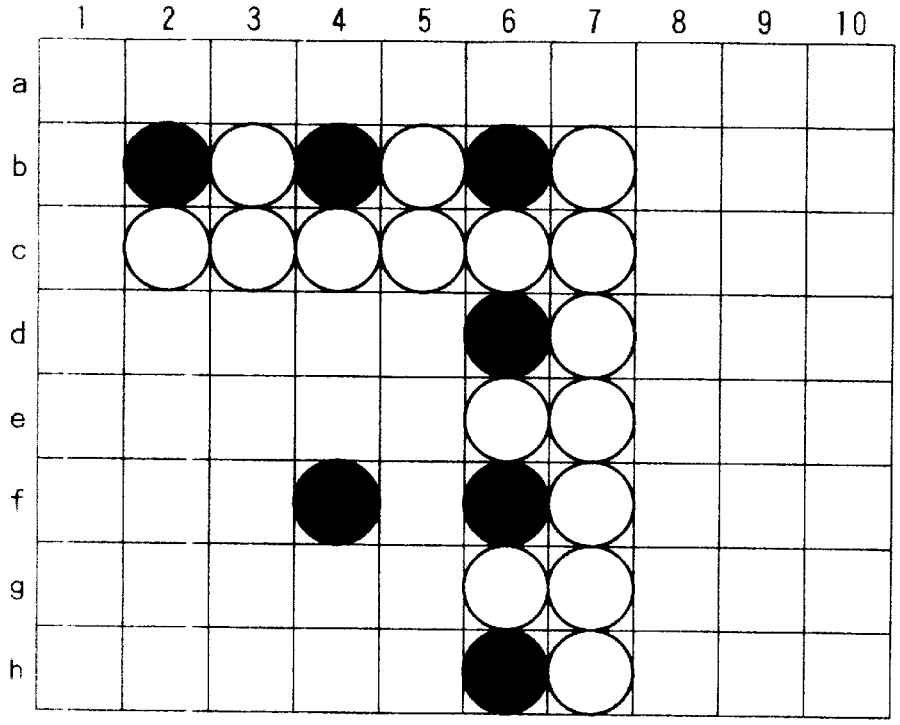
FIG. 15 is a view which shows the process of one embodiment in accordance with another mode embodying the present invention.

Now, in this respect, referring to FIG. 14, a method for controlling the discharge of processing liquid will be described as to a case where an image shown in FIG. 12 is formed by discharging processing liquid onto a recording sheet in an amount of approximately 25% of the recording data as in the related technical example. At first, the data controlling circuit 709 outputs even numbered addresses and read-out signals by means of the pulses of an encoder or the like in order to execute the intended process once in two times. In other words, in FIG. 12, this circuit controls the discharges of processing liquid with respect to each of the even numbered pixel lines 2, 4, 6, 8, and 10 as counted in the main scanning direction. When the head 105 for use of processing liquid arrives at the pixel line 6, the data control circuit 709 outputs addresses and read-out signals so that the recording data are output from the data memories 701, 702, 703 and 704 for each of the colors for such pixel line. The signals from the data memories 701 to 704 for each of the colors are inputted into the OR circuit 721 to operate the 64-bit OR. FIG. 12 shows a part thereof. Those designated by mark ○ are the pixels whose OR becomes 1. These 64-bit data are converted to serial data by the parallel-serial converting circuit 722, and then, the edge detecting circuit 723 detects the edge that changes from 0 to 1. In FIG. 12, it is in the position at (6, b). Based on such data, the ratio control circuit 724 receives the edge signal. Therefore, 1 is set to indicate "discharge". Here, for the ratio control circuit 724, 2 is defined so that signal is output once for every two pixel transfers. Then, AND is operated with the recording image OR signal, that is, the outputs become 1 at the positions of (6, d), (6, f) and (6, h). Likewise, thereafter, whenever the OR output is detected as to one pixel for every two pixels with respect to the edge signals, the output of the ratio control circuit 724 is defined as 1 if there is any output detected therefor. If this process is repeated, the data on processing liquid discharge are obtained as shown in FIG. 15. The mark ● in FIG. 15 designates each pixel onto which processing liquid is discharged.

At this juncture, using the discharge timing the discharge timing signals are formed by the application of pulses from an encoder or the like in accordance with each discharge timing for data on each color. The signals are transferred to the respective heads. Then, only the nozzles whose output data are 1 are output for each color. FIG. 15 is a view which represents the result of discharges effectuated by way of these processes.

As described above, in accordance with the present embodiment, processing liquid is discharged reliably at each edge of recording data, making it possible to cause processing liquid to optimally adhere to a recording sheet in an optimal quantity in order to enhance the fixing and waterproofing capabilities of ink, and also, to average the use ratio of each nozzle of the head for use of processing liquid, because the head for use of processing liquid is structured the same as the head for use of image formation, and nozzles to be used are determined by an image to be recorded.

Figure 16:
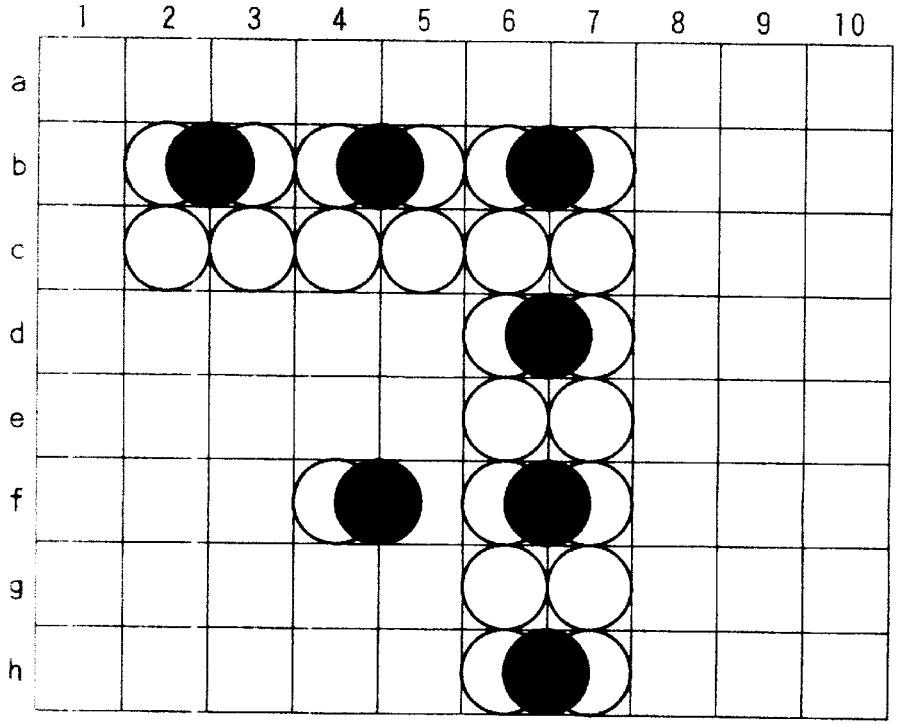
FIG. 16 is a view which shows the process of another embodiment in accordance with another mode embodying the present invention.

In accordance with the embodiment described above, the discharge location of processing liquid is the discharge position of certain color ink. Therefore, the effect of the processing liquid is not necessarily demonstrated uniformly. In order to solve this problem, the discharge timing signal generation unit 746 for use of processing liquid shown in FIG. 14 is additionally provided with a delay unit so that the discharge positions are displaced each half a pixel in the main scanning direction in accordance with the carriage speed. This example will be described as another embodiment. FIG. 16 shows the result of recording with the application of this technique. The processing liquid discharged at (2, b) in the embodiment described above is now placed in the middle position between (2, b) and (3, b). It is shot equally with respect to these two dots. Also, with respect to the dots at (2, c) and (3, c), the distance from them to the discharged processing liquid is closer than that of the result shown in FIG. 15. This makes it possible to use processing liquid more efficiently.

At this juncture, the discharge timing for processing liquid is delayed by a period equivalent approximately to half a pixel portion with respect to color ink. As a result, the processing liquid is equally discharged to the two pixel portions of a color ink discharge location.

As described above, in accordance with the present embodiment, processing liquid is reliably discharged in the vicinity of edges in the direction of data processing, making it possible to arrange an optimal quantity of processing liquid to adhere to a recording sheet optimally for the enhancement of fixing and waterproofing capabilities of ink. Also, since the recording head for use of processing liquid is the same as the recording head for use of image formation, it is possible to determine the nozzles to be used in accordance with images to be recorded, and to average the use ratio of each nozzle of the head for use of processing liquid.

Moreover, using delay means with respect to the discharge timing of processing liquid it is possible to demonstrate the effect of processing liquid in a smaller quantity by defining the discharge locations by use of such means other than the one used for color ink discharge so as to discharge processing liquid more uniformly to color ink discharge locations.

Figure 17:
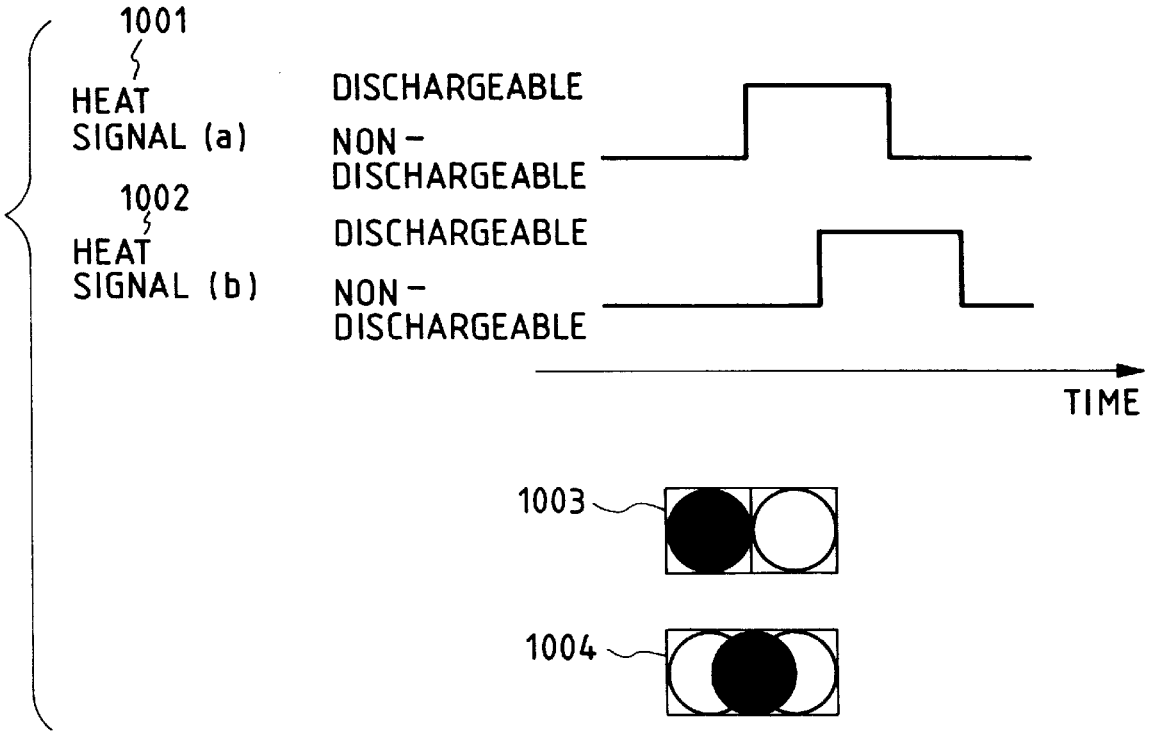
FIG. 17 is a view which illustrates the delay of discharge timing signal.

FIG. 17 is a view which illustrates a case where the discharge timing of processing liquid is controlled in the same manner as to controlling that of the normal color ink, and also, illustrates a case where the timing of discharge timing signals is delayed for use of processing liquid as described in the present embodiment. In FIG. 17, a reference numeral 1001 designates one example of discharge timing signal when control is made as in the case of discharging color ink; 1002, one example of discharge timing signal having a delay in it; 1003, and 1004, the printed locations in color ink and processing liquid by the application of signals 1001 and 1002, which are represented by means of 2×2 matrix (with the omission of two pixel portions), respectively. Those marked with ○ are the discharge locations of color ink, and with ●, those of processing liquid.

Figure 18:
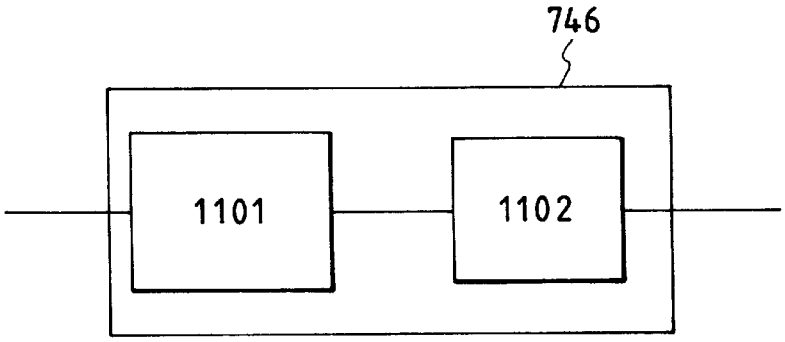
FIG. 18 is a block diagram which schematically shows the structure of a discharge timing signal generation unit for use of processing liquid.

Also, FIG. 18 is a view which schematically shows the structure of the processing liquid discharge timing signal generation unit 746. In FIG. 18, a reference numeral 1101 designates the discharge timing signal generation unit which is the same as for use of color ink discharge, and 1102, a delay unit for discharge timing signals. The structure is arranged so that the discharge timing of processing liquid is delayed half a pixel by defining it in the delay unit in accordance with the carriage speed and others.

In each of the embodiments described above, there is arranged no recording data memory dedicated to use of processing liquid. Only hardware is used for its implementation. However, if a recording data memory is provided for dedicated use of processing liquid, the direction of edge detection is made arbitrary, and the discharge of processing liquid is made definable for all the edges as well.

Likewise, regarding the discharge timing signals, it is possible to detect edges reliably by the control of processing liquid data as described above. As a result, using data the discharge locations can be defined effectively by controlling the delay time when applying the discharge timing signals. Also, as to the control of discharge locations, it is possible to define the delay arbitrarily, not necessarily confined to the half-a-pixel delay. Optimal delay can be defined for each of recording data and recording modes.

Also, in each of the embodiments, the description has been made of 64 nozzles. However, as to each portion where the arrangement of nozzles is disconnected, the present invention produces the same effect in executing the process by detecting it as an edge if there is any recording data being present thereon.

Also, for an ink jet recording apparatus, it is usually practiced that each pixel on the pixel lines in the sub-scanning direction is formed by different nozzles in order to reduce any influences that may be exerted by unevenness or twisting of recording heads. In such case, it is possible to obtain the same effect by modifying the ratio made available by means of the ratio control unit described in each of the embodiments.

As described above, in accordance with the present invention, it is possible to average the use ratio of each nozzle of the head for use of processing liquid. Also, in accordance with the embodiments of the present invention, processing liquid is discharged to recording dots in a closer uniformity, hence making it possible to demonstrate the effect of the processing liquid in a smaller amount of discharge.

In this respect, particularly among ink jet recording methods, the present invention produces excellent effects on a recording head and a recording apparatus of a method where thermal energy generating means (electrothermal transducing elements, laser beam, or the like, for example) is provided for generating energy to be utilized for discharging ink, and ink is caused to change its states by the application of such thermal energy, because a method of the kind makes it possible to attain recording in high density and high precision.

Regarding the typical structure and operational principle of such method, it is preferable to adopt those which can be implemented using the fundamental principle disclosed in the specifications of U.S. Pat. Nos. 4,723,129 and 4,740,796, for example. This method is applicable to the so-called on-demand type recording system and a continuous type recording system as well. Particularly, however, the method is suitable for the on-demand type because the principle is such that at least one driving signal, which provides a rapid temperature rise beyond a departure from nucleation boiling point in response to recording information, is applicable to an electrothermal transducing element disposed on a liquid (ink) retaining sheet or liquid path whereby to cause the electrothermal transducing element to generate thermal energy to produce film boiling on the thermoactive portion of recording means (recording head), thus effectively leading to the resultant formation of a bubble in the recording liquid (ink) one to one in response to each of the driving signals. By the development and contraction of the bubble, the liquid (ink) is discharged through a discharge port to produce at least one droplet. The driving signal is more preferably in the form of pulses because the development and contraction of the bubble can be effectuated instantaneously and appropriately. Therefore, the liquid (ink) is discharged with quicker response. The driving signal in the form of pulses is preferably such as disclosed in the specifications of U.S. Pat. Nos. 4,463,359 and 4,345,262. In this respect, the temperature increasing rate of the thermoactive surface is preferably such as disclosed in the specification of U.S. Pat. No. 4,313,124 for an excellent recording in a better condition.

The structure of the recording head may be as shown in each of the above-mentioned specifications wherein the structure is arranged to combine the discharging ports, liquid paths, and the electrothermal transducing elements (linear type liquid paths or right-angled liquid paths). Besides, the structure, such as disclosed in the specifications of U.S. Pat. Nos. 4,558,333 and 4,459,600 wherein the thermal activation portions are arranged in a curved area, is also included in the present invention. In addition, the present invention is effectively applicable to the structure disclosed in Japanese Patent Application Laid-Open No. 59-123670 wherein a common slit is used as the discharging ports for plural electrothermal transducers, and to the structure disclosed in Japanese Patent Application Laid-Open No. 59-138461 wherein an aperture for absorbing pressure wave of the thermal energy is formed corresponding to the discharge ports. In other words, it is possible to perform recording reliably and more effectively in accordance with the present invention irrespective of the modes of recording heads.

Further, the present invention is effectively applicable to a recording head of full-line type having a length corresponding to the maximum width of a recording medium recordable by the recording apparatus. For such recording head, it may be possible to adopt either a structure whereby to satisfy the required length by combining a plurality of recording heads or a structure arranged by one recording head integrally formed.

Also, for the present invention, it is preferable to additionally provide a recording head with recovery means and preliminarily auxiliary means as constituents of the recording apparatus because these additional means will contribute to making the effectiveness of the present invention more stabilized. To name them specifically, these are capping means, cleaning means, suction or compression means, preheating means such as electrothermal transducing elements or heating elements other than such transducing elements or the combination of those types of elements, and a predischarge means for performing discharge other than the regular discharge with respect to the recording head.

Also, regarding the kinds and numbers of ink jet recording heads to be mounted, the present invention is not only applicable a recording mode in which only one recording head is provided for use of one monochromic ink, but also to an apparatus having plural recording heads provided for use of plural kinds of ink in different colors or in densities. In other words, the present invention is extremely effective in applying it to an apparatus provided with at least one of various recording modes using a multi-color of different colors or a full-color of mixed colors, irrespective of whether the recording heads are integrally structured or it is structured by a combination of plural recording heads.

Furthermore, in the present invention described above, while ink has been described as liquid, it may be an ink material which is solidified below the room temperature but soften or liquefied at the room temperature, or for the ink jet method, since ink is generally controlled within the temperature not lower than 30° C. and not higher than 70° C. in order to stabilize its viscosity for the execution of stable discharge, the ink may be such as to be liquefied when the applicable recording signals are given. In addition, while positively preventing the temperature rise due to the thermal energy by use of such energy as an energy to be consumed for changing states of ink from solid to liquid, or by use of the ink which will be solidified when left intact for the purpose of preventing the ink from being evaporated, it may be possible to adopt for the present invention the use of an ink having a nature of being liquefied only by the application of thermal energy, such as ink capable of being discharged as ink liquid by enabling itself to be liquefied anyway when the thermal energy is given in accordance with recording signals, and also, a kind of ink that will have already begun solidifying itself by the time it reaches a recording medium. In such a case, it may be possible to retain ink in the form of liquid or solid in the recesses or through holes of a porous sheet such as disclosed in Japanese Patent Application Laid-Open No. 54-56847 or 60-71260 in order to keep such ink to face the electrothermal transducing elements. In the present invention, the most effective method applicable to various kinds of ink mentioned above is the one capable of implementing the film boiling method as described above.

Moreover, as the mode of the recording apparatus of the present invention, it may be possible to adopt a copying apparatus combined with a reader or the like, in addition to the image output terminal for a computer or other information processing apparatus. Also, it may be possible to adopt a mode of a facsimile equipment having transmitting and receiving functions, among some others.

What is claimed is:

1. An ink jet recording apparatus, comprising:

a head unit comprising an ink discharge unit for forming ink dots by discharging ink onto a recording medium and a discharge unit for forming liquid dots by discharging onto the recording medium a liquid containing a substance insolubilizing or coagulating colorant in discharged ink;

a recording control data supplying unit for supplying recording control data to the head unit in accordance with recording data for images to be recorded on the recording surface of the recording medium;

edge detecting means for detecting an edge varying from a portion where ink is not applied to a portion where ink is applied in a direction of a scanning on the basis of said recording data; and a data conversion processing unit for forming discharge control data on the discharge operation of said liquid to said discharge unit of the head unit in accordance with said recording control data at a given ratio to the data amount of said recording operation, wherein the liquid dots are applied at said predetermined ratio to application positions where a plurality of ink dots are continuously applied in the direction of said scanning from the edge detected by said edge detecting means, said predetermined ratio being such a value that a number of the applied liquid dots is less than a number of said applied ink dots, and supplying said discharge control data to a head control unit controlling the discharge operation of said head unit so as to form a portion where both ink and the liquid containing substance are applied and a portion where ink only is applied on the recording medium.

2. An ink jet recording apparatus according to claim 1, wherein said recording control data supplying unit is structured with inclusion of an OR circuit unit receiving binarization recording control data corresponding to each of plural ink colors, and a data converting unit for converting output data from said OR circuit unit to continuous data corresponding to the arrangement of said discharge unit, and supplying said data to the units of detecting said edge and forming said discharge control data.

3. An ink jet recording apparatus according to claim 2, comprising:

a memory unit storing binarization recording control data corresponding to each of plural ink colors, and supplying said binarization recording control data to said OR circuit unit corresponding to the relative positions of said heat unit with the recording surface of said recording medium; and a memory operation controlling unit for controlling said memory unit to execute reading operation corresponding to the relative positions of said head unit with the recording surface of said recording medium.

4. An ink jet recording apparatus according to claim 3, wherein said memory operation controlling unit controls said memory unit to supply said OR circuit unit with the binarization recording control data corresponding at least to even numbered pixels or odd numbered pixels of the pixel line to be formed on said recording surface in accordance with said ink discharge unit.

5. An ink jet recording apparatus according to claim 4, wherein the discharge unit of said head unit for discharging liquid containing substance insolubilizing or coagulating colorant in ink is provided in parallel to the discharge unit for discharging ink on the side in the advancing direction of said heat unit.

6. An ink jet recording apparatus according to claim 1, wherein said head unit is provided with thermal energy generating elements for generating thermal energy for discharging ink.

7. An ink jet recording apparatus, comprising:

a head unit comprising an ink discharge unit for forming ink dots by discharging ink onto a recording medium and a discharge unit for forming liquid dots by discharging onto the recording medium a liquid containing a substance insolubilizing or coagulating colorant in discharged ink;

a recording control data supplying unit for supplying recording control data in accordance with recording data for images to be recorded on the recording surface of the recording medium;

an edge detection unit for detecting an edge varying from a portion where ink is not applied to a portion where ink is applied in a direction of a scanning on the basis of said recording data; and a discharge control data formation unit for forming discharge control data on the discharge operation of said liquid to said discharge unit in the head unit in accordance with said recording control data at a given ratio to the data amount of said recording operation on the basis of the recording control data supplied from said recording control data supplying unit and the detection output data supplied from said edge detection unit, and supplying said discharge control data to a head control unit for controlling the discharge operation of both ink and liquid to said head unit so as to form a portion where both ink and the liquid containing substance are applied and a portion where only ink is applied on the recording medium, wherein the liquid dots are applied at said predetermined ratio to application positions where a plurality of ink dots are continuously applied in the direction of said scanning from the edge detected by said edge detecting means, said predetermined ratio being such a value that a number of the applied liquid dots is less than a number of said applied ink dots.

8. An ink jet recording apparatus according to claim 7, wherein at the time of said recording control data being converted to binarization data, said edge detection unit detects edges by detecting the level changes of said binarization data.

9. An ink jet recording apparatus according to claim 7, wherein at the time of said recording control data being converted to binarization data, said edge detection unit detects edges by detecting the level changes of said binarization data along the arrangement of said discharge unit.

10. An ink jet recording apparatus according to claim 7, wherein said discharge control data formation unit forms discharge control data in accordance with OR between said recording control data and the detection output data supplied from said edge detection unit, and said ratio.

11. An ink jet recording apparatus according to claim 7, wherein said recording control data supplying unit is structured with inclusion of an OR circuit unit receiving binarization recording control data corresponding to each of plural ink colors, and a data converting unit for converting output data from said OR circuit unit to continuous data corresponding to the arrangement of said discharge unit, and supplying said data to said edge detection unit and said discharge control data formation unit.

12. An ink jet recording apparatus according to claim 11, comprising:

a memory unit storing binarization recording control data corresponding to each of plural ink colors, and supplying said binarization recording control data to said OR circuit unit corresponding to the relative positions of said heat unit with the recording surface of said recording medium; and a memory operation controlling unit for controlling said memory unit to execute reading operation corresponding to the relative positions of said head unit with the recording surface of said recording medium.

13. An ink jet recording apparatus according to claim 12, wherein said memory operation controlling unit controls said memory unit to supply said OR circuit unit with the binarization recording control data corresponding at least to even numbered pixels or odd numbered pixels of the pixel line to be formed on said recording surface in accordance with said ink discharge unit.

14. An ink jet recording apparatus according to claim 8, wherein the discharge unit of said head unit for discharging liquid containing substance insolubilizing or coagulating colorant in ink is provided in parallel to the discharge unit for discharging ink on the side in the advancing direction of said heat unit.

15. An ink jet recording apparatus according to claim 7, wherein said head unit is provided with thermal energy generating elements for generating thermal energy for discharging ink.

16. An ink jet recording apparatus provided with an ink discharge unit for forming ink dots by discharging ink onto a recording medium on the basis of recording data relating to discharge of ink, and a liquid discharge unit for forming liquid dots by discharging onto said recording medium liquid containing substance insolubilizing or coagulating colorant in said ink, said ink discharge unit and said liquid discharge unit being relatively scanned on the recording medium, said apparatus comprising:

edge detecting means for detecting an edge varying from a portion where ink is not applied to a portion where ink is applied in a direction of a scanning on the basis of said recording data; and control means for controlling forming positions of liquid dots by discharging liquid dots through the liquid discharge unit with a predetermined ratio to ink dots wherein the liquid dots are applied at said predetermined ratio to application positions where a plurality of ink dots are continuously applied in the direction of said scanning from the edge detected by said edge detecting means, said predetermined ratio being such a value that a number of the applied liquid dots is less than a number of said applied ink dots.

17. An ink jet recording apparatus according to claim 16, comprising:

discharge timing signal generation means for generating liquid discharge timing signals; and delay means for delaying the discharge timing signals generated by said discharge timing signal generation means.

18. An ink jet recording apparatus according to claim 16, wherein said edge detection means detects edges of recorded dots in pixel line in the sub-scanning direction.

19. An ink jet recording apparatus according to claim 16, wherein said edge detection means detects edges of recorded dots in pixel lines in the main scanning direction and the sub-scanning direction.

20. An ink jet recording apparatus according to claim 16, wherein said control means defines the edge detected by said edge detection means as the position of the initial processing liquid formation.

21. An ink jet recording apparatus according to claim 17, said delay means performs time delay equivalent to the width of half a pixel.

22. An ink jet recording apparatus according to claim 17, wherein said delay means performs arbitrary time delay in accordance with edge positions.

23. An ink jet recording apparatus according to claim 16, wherein said ink discharge unit and said liquid discharge unit are provided with thermal energy generating elements for generating thermal energy for discharging ink.

24. A method for controlling an ink jet recording apparatus provided with an ink discharge unit for forming ink dots by discharging ink onto a recording medium, and a liquid discharge unit for forming liquid dots by discharging onto said recording medium liquid containing substance insolubilizing or coagulating colorant in said ink, comprising the steps of:

detecting edges of ink dots to be formed on said recording medium; and controlling the ink jet recording apparatus to form positions of liquid dots by discharging liquid dots through the liquid discharge unit with a predetermined ratio to ink dots in accordance with an edge detected by said detection step so as to form a portion where both an ink dot and a liquid dot are applied and a portion where an ink dot only is applied when applying ink dots and liquid dots onto the recording medium.

25. An ink jet recording method for recording on a recording medium, using an ink discharge unit for forming ink dots by discharging ink onto the recording medium on the basis of recording data relating to discharge of ink, and a liquid discharge unit for forming liquid dots by discharging onto said recording medium liquid containing substance insolubilizing or coagulating colorant in said ink, said ink discharge unit and said liquid discharge unit being relatively scanned on the recording medium, said method comprising the steps of:

detecting an edge varying from a portion where ink is not applied to a portion where ink is applied in a direction of a scanning on the basis of said recording data; and controlling forming positions of liquid dots by discharging liquid through the liquid discharge unit with a predetermined ratio to ink dots, wherein the liquid dots are applied at said predetermined ratio to application positions where a plurality of ink dots are continuously applied in the direction of said scanning from the edge detected by said edge detecting step, said predetermined ratio being such a value that a number of the applied liquid dots is less than a number of said applied ink dots.

* * * * *

UNITED STATES PATENT AND TRADEMARK OFFICE

CERTIFICATE OF CORRECTION

PATENT NO. : 6,113,290

DATED : September 5, 2000

INVENTORS : Hideki Tanaka, et al.

It is certified that error appears in the above-identified patent and that said Letters Patent is hereby corrected as shown below:

COVER PAGE

Under [56] References Cited, Foreign Patent Documents, "1-63185 3/1986 Japan" should read --64-63185 3/1989 Japan--; and "05202328" should read --5-202328--.

COLUMN 7

Line 55, "head" should read --heads--.

COLUMN 8

Line 7, please insert --A1 Component--; and
Line 62, "containing" should read --contained--.

COLUMN 11

Line 15, "is" should read --are--.

COLUMN 15

Line 58, "unit" should read --units--.

COLUMN 16

Line 62, "position" should read --positions--.

UNITED STATES PATENT AND TRADEMARK OFFICE

CERTIFICATE OF CORRECTION

PATENT NO. : 6,113,290

DATED : September 5, 2000

INVENTORS : Hideki Tanaka, et al.

It is certified that error appears in the above-identified patent and that said Letters Patent is hereby corrected as shown below:

COLUMN 17

Line 28, "line" should read --lines--.

COLUMN 20

Line 25, "wave" should read --waves--;
Line 40, "preliminarily" should read --preliminary--; and
Line 52, "a" should read --to a--.

COLUMN 24

Line 21, "line" should read --lines--.

Signed and Sealed this

First Day of May, 2001

*Attest:*

Nicholas P. Godici

NICHOLAS P. GODICI

*Attesting Officer*

*Acting Director of the United States Patent and Trademark Office*